US012392109B2

(12) United States Patent
Fujio

(10) Patent No.: US 12,392,109 B2
(45) Date of Patent: Aug. 19, 2025

(54) WORK MACHINE

(71) Applicant: Yanmar Holdings Co., Ltd., Osaka (JP)

(72) Inventor: Kazuhiro Fujio, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 103 days.

(21) Appl. No.: 17/835,955

(22) Filed: Jun. 8, 2022

(65) Prior Publication Data

US 2022/0396932 A1 Dec. 15, 2022

(30) Foreign Application Priority Data

Jun. 14, 2021 (JP) ..... 2021-098701

(51) Int. Cl.

| | |
|---|---|
| ***E02F 9/22*** | (2006.01) |
| ***E02F 9/20*** | (2006.01) |
| ***E02F 9/24*** | (2006.01) |
| ***E02F 9/26*** | (2006.01) |

(52) U.S. Cl.

CPC ..... *E02F 9/2033* (2013.01); *E02F 9/24* (2013.01); *E02F 9/26* (2013.01); *E02F 9/2228* (2013.01); *E02F 9/2285* (2013.01); *E02F 9/2292* (2013.01)

(58) Field of Classification Search

CPC ..... E02F 3/964; E02F 9/262; E02F 9/2033; E02F 9/26; E02F 9/24; E02F 9/265; E02F 9/2246; E02F 9/2292; E02F 9/2228; E02F 9/2285

See application file for complete search history.

(56) References Cited

U.S. PATENT DOCUMENTS

2009/0318263 A1* 12/2009 Yuet ..... B60T 7/16 701/99
2011/0125376 A1* 5/2011 Chappell ..... B60W 10/06 701/65
2014/0121840 A1* 5/2014 Mizuochi ..... G06F 30/15 700/275
2017/0130429 A1* 5/2017 Lafrenier ..... B60Q 5/005
2019/0017248 A1* 1/2019 Okada ..... E02F 9/20
2019/0234048 A1* 8/2019 Zhou ..... E02F 9/26
2020/0315083 A1* 10/2020 Mei ..... A01B 69/00
2021/0025135 A1* 1/2021 Sakuta ..... E02F 9/2253

FOREIGN PATENT DOCUMENTS

EP 3779062 A1 2/2021
JP 2013151830 A 8/2013
JP 2020159142 A 10/2020
WO WO-2019189031 A1 * 10/2019 ..... E02F 9/128

* cited by examiner

*Primary Examiner* — Stephen Holwerda

(74) *Attorney, Agent, or Firm* — Chris Mizumoto

(57) ABSTRACT

A work machine includes a work unit, a main body, a detection unit, and a controller. The work unit executes work. The main body supports the work unit. The detection unit detects a posture of the main body. The controller executes a restriction process of restricting at least one of a motion of the work unit and a motion of the main body based on a detection result of the detection unit.

15 Claims, 13 Drawing Sheets

T11 T12 T13 T14 T15 T16 TB

| CRAWLER | BLADE DIRECTION | UPPER BODY DIRECTION RELATIVE TO CRAWLER | DIRECTION OF WORK MACHINE | RIGHT TURN | LEFT TURN |
|---|---|---|---|---|---|
| FRONT-REAR DIRECTION PARALLEL TO INCLINATION | UPPER DIRETION OF INCLINATION | FRONT (0°) | UPPER DIRETION OF INCLINATION | × | × |
| | | | LOWER DIRECTION OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | LOWER DIRECTION OF INCLINATION | FRONT (0°) | UPPER DIRETION OF INCLINATION | × | × |
| | | | LOWER DIRECTION OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| FRONT-REAR DIRECTION INTERSECTING WITH INCLINATION (90°) | RIGHT WHEN VIEWED FROM LOWER SURFACE OF INCLINATION | FRONT (0°) | RIGHT WHEN VIEWED FROM LOWER SURFACE OF INCLINATION | × | ○ |
| | | | LEFT WHEN VIEWED FROM LOWER SURFACE OF INCLINATION | ○ | × |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | × | × |
| | | | LEFT WHEN VIEWED FROM LOWER SURFACE OF INCLINATION | ○ | ○ |
| | LEFT WHEN VIEWED FROM LOWER SURFACE OF INCLINATION | FRONT (0°) | RIGHT WHEN VIEWED FROM LOWER SURFACE OF INCLINATION | × | ○ |
| | | | LEFT WHEN VIEWED FROM LOWER SURFACE OF INCLINATION | ○ | × |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | UPPER DIRETION OF INCLINATION | × | × |
| | | | LOWER DIRECTION OF INCLINATION | ○ | ○ |

FIG. 8

TB

| T11 CRAWLER | T12 BLADE DIRECTION | T13 UPPER BODY DIRECTION RELATIVE TO CRAWLER | T14 DIRECTION OF WORK MACHINE | T15 RIGHT TURN | T16 LEFT TURN |
|---|---|---|---|---|---|
| FRONT-REAR DIRECTION PARALLEL TO INCLINATION | UPPER DIRETION OF INCLINATION | FRONT (0°) | UPPER DIRETION OF INCLINATION | × | × |
| | | | LOWER DIRECTION OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | LOWER DIRECTION OF INCLINATION | FRONT (0°) | UPPER DIRETION OF INCLINATION | × | × |
| | | | LOWER DIRECTION OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| FRONT-REAR DIRECTION INTERSECTING WITH INCLINATION (90°) | RIGHT WHEN VIEWED FROM LOWER SURFACE OF INCLINATION | FRONT (0°) | RIGHT WHEN VIEWED FROM LOWER SURFACE OF INCLINATION | × | ○ |
| | | | LEFT WHEN VIEWED FROM LOWER SURFACE OF INCLINATION | ○ | × |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | × | × |
| | | | LEFT WHEN VIEWED FROM LOWER SURFACE OF INCLINATION | ○ | ○ |
| | LEFT WHEN VIEWED FROM LOWER SURFACE OF INCLINATION | FRONT (0°) | RIGHT WHEN VIEWED FROM LOWER SURFACE OF INCLINATION | × | ○ |
| | | | LEFT WHEN VIEWED FROM LOWER SURFACE OF INCLINATION | ○ | × |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | OBLIQUELY DOWNWARD (45°) | RIGHT WHEN VIEWED FROM LOWER SURFACE OF INCLINATION | ○ | × |
| | | | LEFT WHEN VIEWED FROM LOWER SURFACE OF INCLINATION | × | ○ |
| | | SIDE (90°) | UPPER DIRETION OF INCLINATION | × | × |
| | | | LOWER DIRECTION OF INCLINATION | ○ | ○ |

FIG. 11

TA

| T1 CRAWLER | T2 BLADE DIRECTION | T3 UPPER BODY DIRECTION RELATIVE TO CRAWLER | T4 DIRECTION OF WORK MACHINE | T5 EXTEND ARM (LOWER BOOM) | T6 BRING ARM CLOSER (RAISE BOOM) |
|---|---|---|---|---|---|
| FRONT-REAR DIRECTION PARALLEL TO INCLINATION | UPPER DIRETION OF INCLINATION | FRONT (0°) | UPPER DIRETION OF INCLINATION | ○ | × |
| | | | LOWER DIRECTION OF INCLINATION | × | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | ○ | × |
| | | OBLIQUELY DOWNWARD (45°) | RIGHT WHEN VIEWED FROM LOWER SURFACE OF INCLINATION | × | ○ |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | ○ | ○ |
| | | | LEFT WHEN VIEWED FROM LOWER SURFACE OF INCLINATION | ○ | ○ |
| | LOWER DIRECTION OF INCLINATION | FRONT (0°) | UPPER DIRETION OF INCLINATION | ○ | × |
| | | | LOWER DIRECTION OF INCLINATION | × | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | ○ | × |
| | | OBLIQUELY DOWNWARD (45°) | RIGHT WHEN VIEWED FROM LOWER SURFACE OF INCLINATION | × | ○ |
| | | | LEFT WHEN VIEWED FROM LOWER SURFACE OF INCLINATION | × | ○ |
| | | SIDE (90°) | RIGHT WHEN VIEWED FROM LOWER SURFACE OF INCLINATION | × | ○ |
| | | | LEFT WHEN VIEWED FROM LOWER SURFACE OF INCLINATION | × | ○ |
| FRONT-REAR DIRECTION INTERSECTING WITH INCLINATION (90°) | RIGHT WHEN VIEWED FROM LOWER SURFACE OF INCLINATION | FRONT (0°) | RIGHT WHEN VIEWED FROM LOWER SURFACE OF INCLINATION | ○ | ○ |
| | | | LEFT WHEN VIEWED FROM LOWER SURFACE OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | ○ | × |
| | | OBLIQUELY DOWNWARD (45°) | RIGHT WHEN VIEWED FROM LOWER SURFACE OF INCLINATION | × | ○ |
| | | | LEFT WHEN VIEWED FROM LOWER SURFACE OF INCLINATION | × | ○ |
| | | SIDE (90°) | UPPER DIRETION OF INCLINATION | ○ | × |
| | | | LOWER DIRECTION OF INCLINATION | × | ○ |
| | LEFT WHEN VIEWED FROM LOWER SURFACE OF INCLINATION | FRONT (0°) | RIGHT WHEN VIEWED FROM LOWER SURFACE OF INCLINATION | ○ | ○ |
| | | | LEFT WHEN VIEWED FROM LOWER SURFACE OF INCLINATION | ○ | ○ |
| | | OBLIQUELY UPWARD (45°) | RIGHT WHEN VIEWED FROM LOWER SURFACE OF INCLINATION | ○ | × |
| | | | LEFT WHEN VIEWED FROM LOWER SURFACE OF INCLINATION | ○ | × |
| | | OBLIQUELY DOWNWARD (45°) | RIGHT WHEN VIEWED FROM LOWER SURFACE OF INCLINATION | × | ○ |
| | | | LEFT WHEN VIEWED FROM LOWER SURFACE OF INCLINATION | × | ○ |
| | | SIDE (90°) | UPPER DIRETION OF INCLINATION | ○ | × |
| | | | LOWER DIRECTION OF INCLINATION | × | ○ |

WORK MACHINE

CROSS-REFERENCE

This application claims foreign priority of IP2021-098701 filed Jun. 14, 2021, the disclosure of which is hereby incorporated by reference in its entirety

TECHNICAL FIELD

The present disclosure relates to a work machine.

BACKGROUND ART

The hydraulic excavator described in Patent Document 1 includes a safety device against overturning. The safety device against overturning calculates the center of gravity of the hydraulic excavator. The safety device against overturning calculates a center-of-gravity safety zone. The safety device against overturning outputs a warning when the center of gravity approaches a boundary of the center-of-gravity safety zone.

PRIOR ART DOCUMENT

Patent Document

Patent Document 1: Japanese Unexamined Patent Application Publication No. 7-207711

SUMMARY OF INVENTION

Technical Problem

However, the work machine, such as the hydraulic excavator, described in Patent Document 1 does not restrict a motion of the work machine located on an inclined surface, and therefore, tipping-over of the work machine caused by a motion of the work machine may not be avoided.

The present disclosure is made in view of the above-mentioned problem, and it is an object to provide a work machine that can be restrained from tipping-over caused by a motion of the work machine in an inclined state.

Solution to Problem

According to an aspect of the disclosure, a work machine includes a work unit, a main body, a detection unit, and a controller. The work unit performs works. The main body supports the work unit. The detection unit detects a posture of the main body. The controller executes a restriction process of restricting at least one of a motion of the work unit and a motion of the main body based on a detection result of the detection unit.

Advantageous Effects of Invention

According to the work machine of the present disclosure, the work machine can be prevented from tipping-over caused by a motion of the work machine in an inclined state.

BRIEF DESCRIPTION OF DRAWINGS

FIG. 8 is a diagram illustrating a pattern table of a swivel body of the work machine according to the embodiment.

FIG. 11 is a diagram illustrating a pattern table of a work unit of the work machine according to the embodiment.

DESCRIPTION OF EMBODIMENTS

Figure 1:
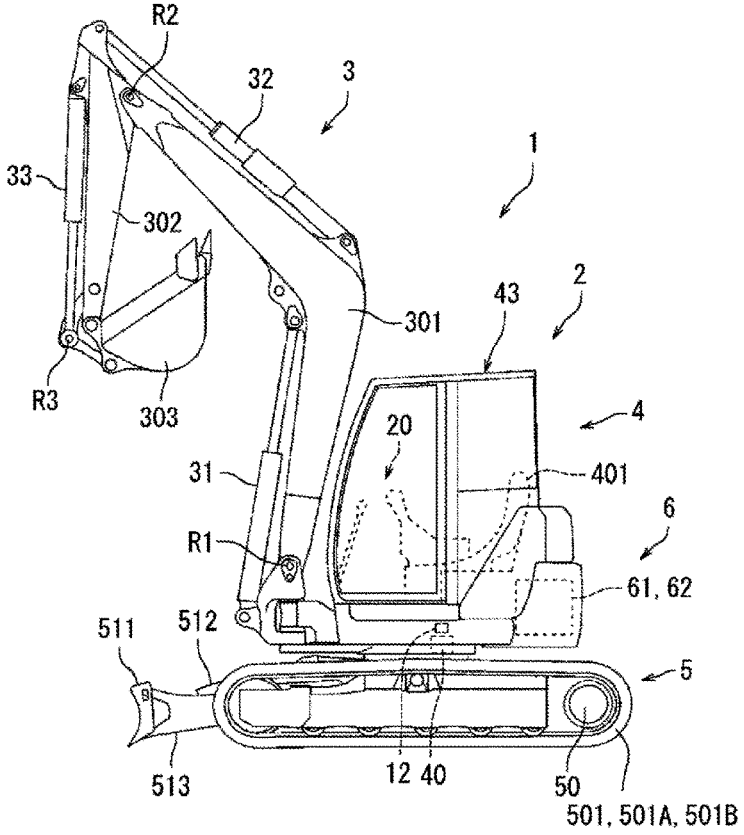
FIG. 1 is a diagram illustrating a work machine according to an embodiment of the present disclosure.

An embodiment of the present disclosure will be described hereinafter with reference to the accompanying drawings. Note that the present disclosure is not limited to the embodiment below. The explanation may be omitted where the explanation is duplicated as appropriate. Furthermore, in the drawings, the same reference signs are used for the same or equivalent components, and redundant descriptions are omitted.

First Embodiment

Referring to FIG. 1, a work machine 1 according to an embodiment of the present disclosure will be described. The work machine 1 includes construction machinery and agricultural machinery, for example, and may be self-propelled or stationary machinery. The following is an example of this embodiment where the work machine 1 is a hydraulic excavator. A hydraulic excavator is an example of construction machinery.

FIG. 1 is a diagram illustrating a work machine 1 according to this embodiment. As illustrated in FIG. 1, the work machine 1 of this embodiment includes a main body 2, a work unit 3, and an engine unit 6. The main body 2 supports the work unit 3. The main body 2 includes a swivel body 4 and a traveling body 5.

The swivel body 4 is supported by the traveling body 5. Specifically, the swivel body 4 is positioned over the traveling body 5, for example, via a swivel bearing. The swivel body 4 is supported by the traveling body 5 in a swivelable manner.

The swivel body 4 includes a cabin 43 and a swivel motor 40. The engine unit 6 is included in the swivel body 4.

The cabin 43 accommodates a driver's seat 401 and an operating unit 20. An operator sits on the driver's seat 401. In this specification, a left side viewed from the operator seated on the driver's seat 401 may be described as a left direction. Similarly, a right side viewed from the operator seated on the driver's seat 401 may be described as a right direction. A front side viewed from the operator seated on the driver's seat 401 may be described as a front direction. A rear side viewed from the operator seated on the driver's seat 401 may be described as a rear direction.

The operating unit 20 can individually operate the work unit 3, the swivel body 4, and the traveling body 5. The operator seated on the driver's seat 401 operates the operating unit 20 so as to individually control the work unit 3, the swivel body 4, and the traveling body 5. The operating unit 20 includes a traveling lever (not shown) that operates the traveling body 5. The traveling lever can cause the traveling body 5 to travel irrespective of a swivel angle of the swivel body 4, and in FIG. 1, when the traveling lever is tilted toward the front of the machine (to the left in the drawing), the work machine 1 travels in the left direction in the drawing. Furthermore, in a case where the swivel body 4 swivels 180° and faces the right side in the drawing, when the traveling lever is tilted toward the front of the machine (to the right in the drawing), the machine travels in the left direction in the drawing.

The swivel motor 40 swivels the cabin 43. Specifically, the swivel motor 40 swivels the cabin 43 via the swivel bearing. The swivel motor 40 is, for example, a hydraulic motor. The swivel motor 40, for example, swivels the cabin 43 in the left direction or the right direction relative to the traveling body 5 in response to an operation performed on the operating unit 20.

The traveling body 5 causes the work machine 1 to travel. Specifically, for example, the traveling body 5 is driven by pressure oil discharged by a hydraulic pump 7 (main pump 71) powered by the engine unit 6, and causes the work machine 1 to travel in accordance with an operation performed on the operating unit 20. In this embodiment, the traveling body 5 is a crawler-type traveling device. Specifically, the traveling body 5 includes a traveling motor 50 and a crawler 501. Note that the pressure oil is the hydraulic oil to which high pressure is applied to operate a hydraulic actuator described below.

The crawler 501 is a pair of crawlers 501. The pair of crawlers 501 includes a first crawler 501A and a second crawler 501B. The first crawler 501A is disposed in the left direction. The second crawler 501B is disposed in the right direction.

The traveling motor 50 rotates and drives the crawler 501. The traveling motor 50 is, for example, a hydraulic motor. The traveling motor 50 is a pair of traveling motors 50. The pair of traveling motors 50 includes a first traveling motor and a second traveling motor. The first traveling motor rotates and drives the first crawler 501A. The second traveling motor rotates and drives the second crawler 501B.

The traveling body 5 further includes a blade 511, a blade cylinder 512, and a blade arm 513. The blade 511 has a soil removal mechanism and is used for a ground leveling operation and other operations. The blade 511 has a plate shape. The blade cylinder 512 drives the blade 511. The blade arm 513 supports the blade 511.

The work unit 3 execute work. Specifically, for example, the work unit 3 is driven by power supplied from the engine unit 6 and performs soil excavation work in response to an operation of the operating unit 20. In this embodiment, the work unit 3 includes a boom 301, an arm 302, a bucket 303, a boom cylinder 31, an arm cylinder 32, and a bucket cylinder 33.

The boom 301 is supported by the swivel body 4 to swing with a first rotation supporting point R1 at a center.

The boom cylinder 31 actuates the boom 301. Specifically, the boom cylinder 31 is driven by hydraulic fluid to cause the boom 301 to be swung with the first rotation supporting point R1 at the center. The boom cylinder 31 includes a cylinder body, a piston that divides an internal space of the cylinder body into two hydraulic chambers, and a rod that is connected to the piston at one end and outputs hydraulic power. The piston is moved forward and backward inside the cylinder body by the hydraulic fluid, and the rod actuates the boom 301.

The arm 302 is supported by the boom 301 to swing with a second rotation supporting point R2 at a center.

An arm cylinder 32 actuates the arm 302. Specifically, the arm cylinder 32 is driven by the hydraulic fluid and causes the arm 302 to be swung with the second rotation supporting point R2 at the center. The arm cylinder 32 has the same configuration as the boom cylinder 31 described above.

The bucket 303 is a type of attachment. The bucket 303 is supported by the arm 302 to swing via a bucket link (not shown) at an end of the arm 302 with a third rotation supporting point R3 at a center. Furthermore, a crane hook (not shown) for a suspending operation is attached to the bucket link.

A bucket cylinder 33 actuates the bucket 303. Specifically, the bucket cylinder 33 is driven by the hydraulic fluid and causes the bucket 303 to be swung with the third rotation supporting point R3 at the center. The bucket cylinder 33 has the same configuration as the boom cylinder 31 described above.

The engine unit 6 drives a hydraulic pump 7 (main pump 71) described below to dispense pressure oil so as to drive the boom cylinder 31, the arm cylinder 32, the bucket cylinder 33, the swivel motor 40, the first traveling motor, and the second traveling motor. Note that the boom cylinder 31, the arm cylinder 32, the bucket cylinder 33, the swivel motor 40, the first traveling motor, and the second traveling motor may be collectively referred to as hydraulic actuators where appropriate hereinafter.

In the work machine 1 having the above-described configuration, the traveling body 5 travels by rotation drive of the traveling motor 50, and the swivel body 4 swivels by swivel drive of the swivel motor 40. Furthermore, the bucket 303 moves upward, downward, forward, and backward by extension and retraction of the boom cylinder 31 and the arm cylinder 32, and the bucket 303 performs a dump operation or a cloud operation by extension and retraction of the bucket cylinder 33.

Figure 2:
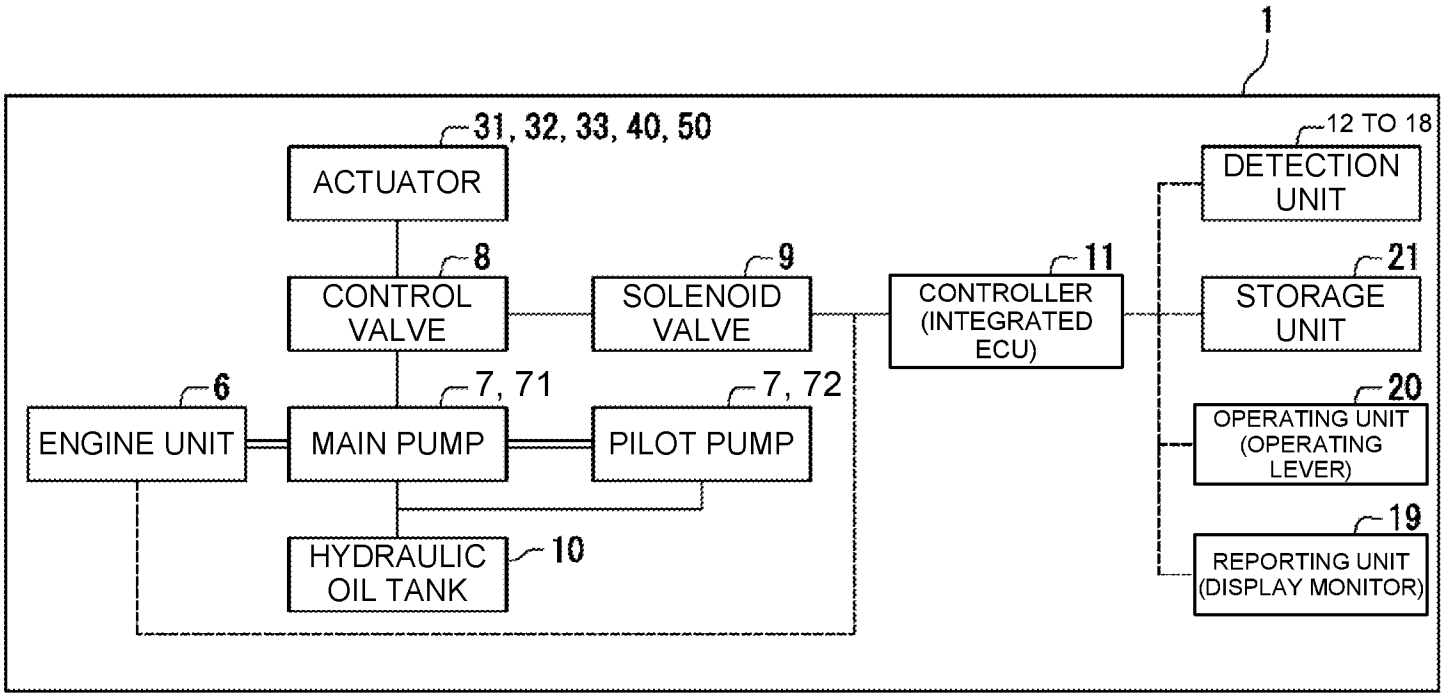
FIG. 2 is a block diagram illustrating a hydraulic configuration and an electrical configuration of the work machine according to the embodiment.

Referring to FIGS. 1 and 2, operation of the work machine 1 will be described in more detail. FIG. 2 is a block diagram illustrating a hydraulic configuration and an electrical configuration of the work machine 1.

As shown in FIG. 2, the work machine 1 includes the engine unit 6 described above, the hydraulic pump 7 (main pump 71 and pilot pump 72), a control valve 8, a solenoid valve 9, a hydraulic oil tank 10, a controller 11, and detection units 12 to 18.

As illustrated in FIG. 1, the engine unit 6 of the work machine 1 of this embodiment includes an engine 61 and an engine controller 62. The engine controller 62 is an ECU (Engine Control Unit), for example. Fuel is supplied from a fuel tank (not shown) to the engine 61.

The engine 61 drives the hydraulic pump 7 (main pump 71 and pilot pump 72). As a result, the hydraulic pump 7 (main pump 71) discharges pressure oil from the hydraulic oil tank 10 and supplies the pressure oil to the control valve 8. The control valve 8 is used to supply the pressure oil to individual hydraulic actuators 31, 32, 33, 40, and 50. Consequently, the boom cylinder 31, the arm cylinder 32, the bucket cylinder 33, the swivel motor 40, the traveling motor 50 (first traveling motor and second traveling motor) are driven.

The hydraulic pump 7 (pilot pump 72) discharges pilot oil from the hydraulic oil tank 10 and supplies the pilot oil to the solenoid valve 9. The solenoid valve 9 outputs the pilot oil to a control port of the control valve 8 in accordance with an operation performed on the operating unit 20 connected via the controller 11. As a result, the control valve 8 supplies pressure oil in which a direction and a flow rate thereof are controlled in accordance with the pilot oil to the individual hydraulic actuators 31, 32, 33, 40, and 50.

The work machine 1 further includes the first detection unit 12, the second detection unit 13, the third detection unit 14, the fourth detection unit 15, the fifth detection unit 16, the sixth detection unit 17, and the seventh detection unit 18. The detection units 12 to 18 are individually connected to the controller 11.

The first detection unit 12 detects a posture of the main body 2. The first detection unit 12 corresponds to an example of a "detection unit" of the present disclosure. The posture of the main body 2 indicates an inclination of the main body 2 and a direction of the main body 2 relative to an inclined surface. The inclination of the main body 2 indicates an angle of a surface where the main body 2 is located and a tilt of the main body 2 in accordance with the angle of the surface where the main body 2 is located, for example. Specifically, when the main body 2 is located on an inclined surface, a posture of the main body 2 is obtained in accordance with an angle of the inclined surface. The first detection unit 12 is mounted on the swivel body 4. The first detection unit 12 may be, for example, an inclination sensor, a rotation angle sensor, or a capacitance sensor. The first detection unit 12 may be an IMU (inertial measurement unit). The inertial measurement unit measures a roll angle of the main body 2 and a pitch angle of the main body 2. The first detection unit 12 outputs a detection result to the controller 11.

The second detection unit 13 includes an angle sensor, for example, to detect an angle of the boom 301. The second detection unit 13 detects the angle of rotation of the boom 301. The second detection unit 13 is, for example, a potentiometer or a rotary encoder. The second detection unit 13 outputs a detection result to the controller 11.

The third detection unit 14 includes an angle sensor, for example, to detect an angle of the arm 302. The third detection unit 14 detects an angle of rotation of the arm 302. The third detection unit 14 is, for example, a potentiometer or a rotary encoder. The third detection unit 14 outputs a detection result to the controller 11.

The fourth detection unit 15 includes an angle sensor, for example, to detect an angle of the bucket 303. The fourth detection unit 15 detects an angle of rotation of the bucket 303. The fourth detection unit 15 is, for example, a potentiometer or a rotary encoder. The fourth detection unit 15 outputs a detection result to the controller 11.

The fifth detection unit 16 acquires swivel angle information of the swivel body 4. The fifth detection unit 16 can detect a swivel angle of the swivel body 4 relative to the traveling body 5. The fifth detection unit 16 is, for example, a potentiometer or a rotary encoder. The fifth detection unit 16 is mounted, for example, on the swivel bearing not illustrated. The fifth detection unit 16 outputs a detection result to the controller 11.

The sixth detection unit 17 is attached to the boom cylinder 31 and detects pressure of the hydraulic oil supplied to the boom cylinder 31. The sixth detection unit 17 outputs a detection result to the controller 11.

The controller 11 can calculate a load of an excavated object accommodated in the bucket 303 based on the pressure of the hydraulic fluid detected by the sixth detection unit 17. Furthermore, the controller 11 can calculate a load of an object suspended on the crane hook based on the pressure of the hydraulic fluid detected by the sixth detection unit 17. Note that, in a description below, the load of the accommodated object in the bucket 303 and the load of the object suspended on the crane hook are collectively referred to as a "suspended load" where appropriate.

The seventh detection unit 18 detects a state of environment surrounding the work machine 1. The seventh detection unit 18 is, for example, a measurement range sensor, such as a TOF (Time Of Flight) camera. The TOF camera is, for example, a lidar. Specifically, the seventh detection unit 18, for example, emits light around the work machine 1 and receives reflection light. The seventh detection unit 18 then outputs a signal corresponding to the received reflection light as a detection result to the controller 11. That is, the seventh detection unit 18 outputs a signal indicating a state of the environment surrounding the work machine 1 to the controller 11. The seventh detection unit 18 may be a millimeter wave radar, a camera, or a stereo camera, for example.

Furthermore, as shown in FIG. 2, the work machine 1 further includes a reporting unit 19, the controller 11, and a storage unit 21.

The reporting unit 19 reports information indicating a state of the work machine 1 (hereinafter referred to as "state information" where appropriate) to the operator. The information reported by the reporting unit 19 includes, for example, a posture (inclination angle) of the main body 2, a suspended load, a posture of the work unit 3, a traveling speed of the work machine 1, a degree of risk of tipping-over of the work machine 1, and a warning (including content of control to prevent tipping-over). The warning includes restriction and prohibition a motion of the work machine 1. The reporting unit 19 includes at least one visual reporting unit and one auditory reporting unit. The visual reporting unit includes, for example, a light-emitting unit and a display unit. The light-emitting unit is, for example, an LED (Light Emitting Diode) that reports state information by emitting light. For example, the light-emitting unit indicates a state of the work machine 1 by a light-emitting color or a light-emitting method. Specifically, when the state of the work machine 1 (tipping-over risk) is indicated by a light-emitting color, green indicates no tipping-over risk (safe state), yellow indicates low tipping-over risk (caution state), and red indicates high tipping-over risk (warning state). On the other hand, when the state of the work machine 1 (tipping-over risk) is indicated by a light-emitting method, light is turned off when there is no tipping-over risk (safe state, light is turned on when tipping-over risk is low (caution state), and light blinks when tipping-over risk is high (warning state). The display unit is composed of a display, such as a liquid crystal display or an organic EL display, and reports state information by displaying a message or an icon indicating the state of the work machine 1. The auditory reporting unit is, for example, a speaker. The speaker reports a state of the work machine 1 by outputting a voice message or sound (including an alarm).

The storage unit 21 includes a storage device and stores data and computer programs. Specifically, the storage unit 21 includes a main storage device, such as a semiconductor memory, and an auxiliary memory device, such as a semiconductor memory, a solid state drive, and/or a hard disk drive. The storage unit 21 may include a removable medium.

The controller 11 controls the work machine 1. The controller 11 includes a processor, such as an integrated ECU (Electronic Control Unit). The processor of the controller 11 controls the work machine 1 by executing the computer programs stored in the storage unit 21.

Determination Process

Figure 3:
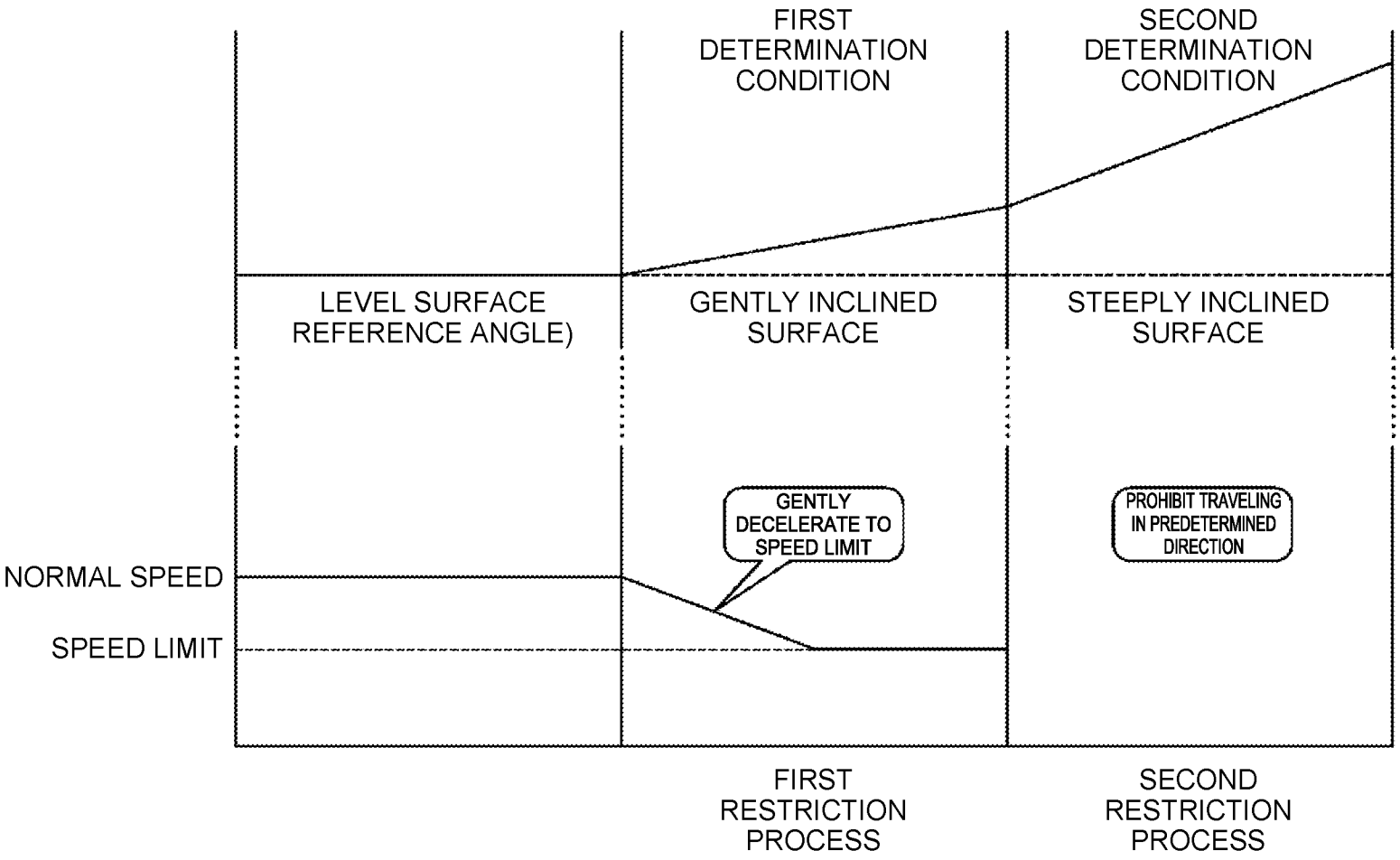
FIG. 3 is a diagram illustrating an example of a process executed by a controller of the work machine according to the embodiment.

Referring now to FIGS. 1 to 3, a determination process, performed by the controller 11, of determining a posture of the work machine 1 based on a detection result of the first detection unit 12 will be described. FIG. 3 is a diagram illustrating an example of a process executed by the controller 11 of the work machine 1 according to the embodiment. When obtaining a detection result from the first detection unit 12, the controller 11 determines a posture of the work machine 1 (posture of the main body 2: inclined state) with reference to a determination condition stored in the storage unit 21. For example, in a case where the determination condition indicates a risk of tipping-over in an inclination of 10° or more, when a detection result of the first detection unit 12 is 12°, the controller 11 determines that the work machine 1 has a risk of tipping-over in the posture thereof.

The determination process can detect a posture of the work machine 1 at a certain temporary point or a temporal change in a posture of the work machine 1. For example, the determination process can detect a change in a posture of the work machine 1 during traveling, or a change in a posture in accordance with a change in an environment where the work machine 1 is located. The change in the environment where the work machine 1 is located means, for example, a mechanical change in an inclination of a pedestal that supports the work machine 1.

Furthermore, when a change in a posture during traveling of the work machine 1 is detected, the detected posture of the main body 2 maintained for a predetermined period of time may be added to the determination condition. Specifically, for example, when the work machine 1 enters an inclined surface from a level surface by a traveling motion, an angle of the inclined surface is detected as a posture of the main body 2 for a period of traveling on the inclined surface, so that a change in a posture is detected using a posture of the work machine 1 in the level surface and a posture of the work machine 1 in the inclined surface. On the other hand, when the work machine 1 travels on an uneven road surface, a posture of the work machine 1 frequently changes according to the uneven surface, and therefore, the controller 11 does not detect a change in the posture of the work machine 1. As a result, a restriction process caused by false detection can be prevented from being performed.

Note that, in the determination process, determinations can be performed in stages by setting different determination conditions of different degrees. For example, a first determination condition with a relatively low risk of tipping-over and a second determination condition with a relatively high risk of tipping-over may be set. Specifically, the first determination condition includes an angle of the main body 2 indicated by a posture of the main body 2 that is equal to or larger than a first threshold value. In this case, an inclination angle for the first determination condition is equal to or larger than 10° (first threshold value) and smaller than 30°, and an inclination angle for the second determination condition is equal to or larger than 30° (second threshold value), for example.

In the determination process, a posture (inclined state) of the work machine 1 is calculated based on a reference posture. The reference posture indicates a posture (inclination angle) of the main body 2 serving as a reference of the detection of a posture of the work machine 1, and includes a posture (inclination angle) obtained when the main body 2 is located on a level surface or a posture (inclination angle) of the main body 2 obtained when the posture detection is started. The reference posture includes a posture of the main body 2 obtained when the main body 2 is placed on a level surface. Therefore, the controller 11 can perform a restriction process based on a change in a posture of the main body 2 placed on a level surface. Accordingly, the restriction process can be executed when a posture is changed from the reference posture. The reference posture may further include a posture of the main body 2 detected by the first detection unit 12 before the posture of the main body 2 changes (posture of the main body 2 at the start of the detection process). Accordingly, the controller 11 can detect a change in a posture during traveling and determine that an unstable state is entered due to a traveling motion even though the machine is in a stable state at the start of traveling.

Other Examples of Determination

Example of Determination Using Posture Detection Result of Work Unit 3

In the above example, a posture of the main body 2 is detected to determine a state of the work machine 1, but the detection is not limited to this. For example, a posture of the work unit 3 may be detected, and the controller 11 may execute the determination process based on a result of the posture detection of the work unit 3. In this determination example, the controller 11 specifies a posture of the work unit 3. Specifically, the controller 11 specifies a posture of the work unit 3 based on a detection result of the second detection unit 13, a detection result of the third detection unit 14, and a detection result of the fourth detection unit 15. More specifically, the controller 11 specifies positions of the boom 301, the arm 302, and the bucket 303 based on an angle of rotation of the boom 301, an angle of rotation of the arm 302, an angle of rotation of the bucket 303, a length of the boom 301, a length of the arm 302, and a length of the bucket 303. Then the controller 11 specifies a posture of the work unit 3 based on information on the position of the bucket 303. For example, the controller 11 determines that a risk of tipping-over of the work machine 1 is high when the boom 301 and the arm 302 are extended far from the main body 2. Furthermore, the controller 11 determines that a risk of tipping-over of the work machine 1 is low when the boom 301 and the arm 302 are retracted close to the main body 2.

Example of Determination Using Suspended Load Detection Result

As another determination method, a determination may be made based on a suspended load. In this determination example, the controller 11 determines a state of the work machine 1 based on a detection result of the sixth detection unit (load sensor) 17. For example, the controller 11 determines that the work machine 1 is at high risk of tipping-over when the suspended load is greater than a predetermined threshold value. For example, the controller 11 determines that the work machine 1 is at low risk of tipping-over when the suspended load is equal to or smaller than the predetermined threshold value.

The above is a description of the method of determination process in the present disclosure with some examples, but the method is not limited to this and various modifications may be made. For example, a plurality of determination methods may be combined to perform a determination process. Specifically, a determination process combining the posture detection result of the main body 2 and the posture detection result of the work unit 3, a determination process combining the posture detection result of the main body 2 and the detection result of the suspended load, and a determination process combining the posture detection result of the main body 2, the posture detection result of the work unit 3, and the detection result of the suspended load may be employed.

Restriction Process

Next, a restriction process of restricting operation of the work machine 1 performed by the controller 11 will be described. Specifically, the controller 11 restricts motions of the main body 2 and/or the work unit 3 by the restriction process. Examples of the restriction on a motion of the main body 2 include restriction on a traveling motion of the traveling body 5 and a swivel motion of the swivel body 4. In addition, the motion restriction of the work unit 3 includes restriction of rotation motions of the boom 301, the arm 302, and the bucket 303.

Examples of the motion restriction include restriction of a motion speed and prohibition of a motion. The prohibition of a motion includes prohibition of a motion out of a predetermined range and prohibition of a motion in a predetermined direction. In the restriction process, the controller 11, for example, sends a control signal to the engine controller 62 of the engine unit 6 to control an engine speed, or sends a control signal to the solenoid valve 9 to control the communication state of the pilot oil. Specifically, when the controller 11 sends a control signal to the engine controller 62, the engine speed is reduced, a discharge amount of the main pump 71 is reduced, and a flow rate of the pressure oil supplied to the hydraulic actuator is reduced, and therefore, an operation speed of the hydraulic actuator is reduced. When the controller 11 sends a control signal to the solenoid valve 9, the flow rate of the pilot oil passing through the solenoid valve 9 changes. When the flow rate of the pilot oil passing through the solenoid valve 9 is reduced, an operation speed of the hydraulic actuator is reduced. When the pilot oil does not pass through the solenoid valve 9, the hydraulic actuator stops. The controller 11 may restrict the rotation speed of the engine 61 in stages.

Furthermore, the controller 11 can also restrict a motion of the work machine 1 in stages in the restriction process. For example, a first restriction process that imposes relatively light restriction and a second restriction process that imposes relatively heavy restriction may be set. For example, a motion speed is restricted in the first restriction process, and a motion is prohibited in the second restriction process. Furthermore, the controller 11 can execute the restriction process based on determination conditions. For example, the first restriction process may be executed based on the first determination condition and the second restriction process may be executed based on the second determination condition. The following is a detailed description of the restriction process with specific examples.

Restriction of Traveling Motion: Process of Restricting Traveling Motion of Traveling Body 5

Figure 4:
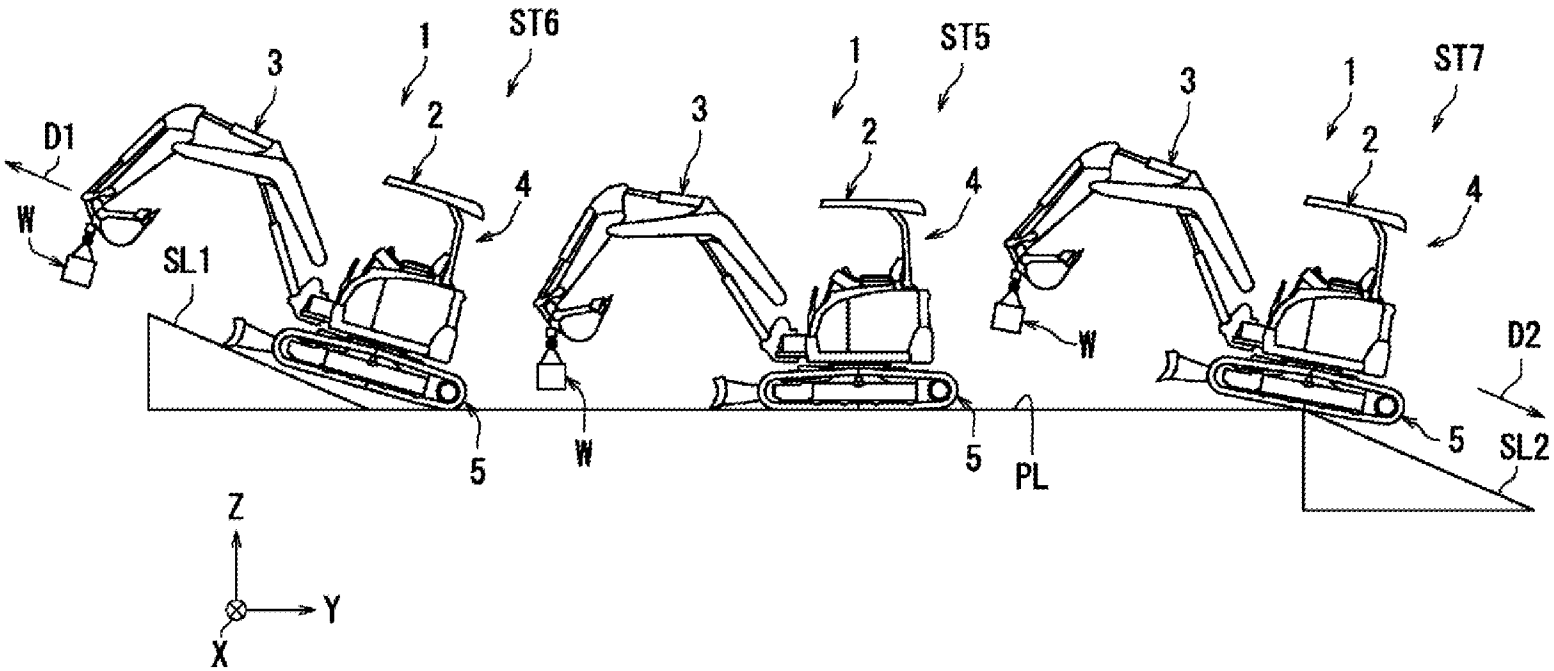
FIG. 4 is a diagram illustrating the work machine according to the embodiment.

First, a process of restricting a motion of the traveling body 5 performed by the controller 11 will be described in detail with reference to FIG. 4. FIG. 4 is a diagram illustrating a traveling state of the work machine 1, and specifically, a state of traveling on a level surface PL (fifth posture ST5) is illustrated in a center of the drawing, a state in which the work machine 1 enters an upward inclination (first inclined surface SL1) from the level surface PL is illustrated in a left portion in the drawing (sixth posture ST6), and a state in which the work machine 1 enters a downward inclination (second inclined surface SL2) from the level surface PL is illustrated in a right portion in the drawing (seventh posture ST7). Note that, in FIG. 4, the work unit 3 in the work machine 1 is positioned in a direction in which the work machine 1 climbs the inclination (first inclination direction D1) and is suspending an object W. Note that the first inclination direction D1 indicates a direction from a base end of the inclined surface SL to a top of the inclined surface SL. Specifically, the first inclination direction D1 indicates a direction in which the work machine 1 moves upward on the inclined surface SL where the main body 2 is located. The first inclination direction D1 indicates a so-called direction toward a mountain side. Although the work unit 3 is positioned in a direction in which the work unit 3 moves upward on the inclination (first inclination direction D1) in the example of FIG. 4, the same is true of a case where the work unit 3 is positioned in a direction in which the work unit 3 moves downward on the inclination (second inclination direction D2), and therefore, a description thereof is omitted.

Traveling Motion in Upward State on Inclination

First, restriction control of a traveling motion in which the work machine 1 enters an upward inclination (first inclined surface SL1) from the level surface PL will be described below.

Restriction of Traveling Speed

When the sixth posture ST6 of the work machine 1 satisfies the determination condition described above, the controller 11 restricts a motion of the traveling body 5, for example. Specifically, the controller 11 reduces a traveling speed to a speed limit as shown in FIG. 3. The speed limit is a speed low enough to avoid tipping-over of the work machine 1. For example, the speed limit is a preset speed (first speed) or a speed obtained by multiplying a traveling speed of the work machine 1 at a time of the posture detection by a predetermined coefficient (second speed), and one of the speeds may be selected. Specifically, in a case where the preset speed is 3 km/hour and the predetermined coefficient is 0.7, when a traveling speed of the work machine 1 at a time of the posture detection is 5 km/hour, the first speed is 3 km/hour and the second speed is 3.5 km/hour. Furthermore, when a slower one of the first and second speeds is selected, the first speed (3 km/hour) is the speed limit. The speed is gradually reduced with a predetermined deceleration rate to control increase in risk of tipping-over due to a sudden change in speed. Specifically, even when the operator performs an abrupt operation, at least one of the followings is restricted (gradually decelerated): a speed of a work motion of the work unit 3, a speed of a traveling motion of the traveling body 5, and a speed of a swivel motion of the swivel body 4.

Prohibition of Traveling Motion

Furthermore, when the sixth posture ST6 of the work machine 1 satisfies the determination condition described above, the controller 11 may prohibit a traveling motion as the motion restriction of the traveling body 5. For example, a traveling motion in a predetermined direction may be restricted. In the example of FIG. 4, a traveling motion in the first inclination direction D1 toward the first inclined surface SL1 from the level surface PL (direction in which an inclination angle of the work machine 1 increases) may be prohibited. Therefore, the traveling motion of the traveling body 5 in a direction that increases the risk of tipping-over of the work machine 1 (i.e., that increases a change in a position of the center of gravity) is restricted. As a result, the work machine 1 that has entered the first inclined surface SL1 by the traveling motion of the traveling body 5 is prevented from further traveling in the first inclination direction D1. In other words, a motion of the traveling body 5 in a direction in which the risk of tipping-over of the work machine 1 is lowered (e.g., a direction in which the work machine 1 returns to the reference posture) is permitted. Thus, by restricting a motion of the work machine 1 in a state of high risk of tipping-over, occurrence of tipping-over is avoided. Note that, in a traveling motion on the upward inclination, the first inclination direction D1 in FIG. 4 corresponds to an example of a "first predetermined direction" of the present disclosure.

On the other hand, the controller 11 can also restrict a traveling range as another restriction process that prohibits a traveling motion. In the process of restricting a traveling range, the controller 11 may restrict a traveling range in the first inclination direction D1 or the second inclination direction D2, for example.

In this way, the controller 11 executes the restriction process, such as restriction of a traveling speed or prohibition of a traveling motion, based on a determination result indicating a posture of the work machine 1. In this case, the controller 11 may execute the restriction process in stages, and for example, a traveling speed may be restricted as a first restriction process based on the first determination condition and a traveling direction may be restricted as a second restriction process based on the second determination condition.

Traveling Motion in Downward State on Inclination

Next, a traveling motion in which the work machine 1 enters a downward inclination (second inclined surface SL2) from the level surface PL that is also a target of the restriction process similarly to the traveling motion on the upward inclination described above will be described hereinafter.

Restriction of Traveling Speed

Furthermore, when the seventh posture ST7 of the work machine 1 satisfies the determination condition described above, the controller 11 reduces a traveling speed to the speed limit as the motion restriction of the traveling body 5.

Prohibition of Traveling Motion

Furthermore, when the seventh posture ST7 of the work machine 1 satisfies the determination condition described above, the controller 11 may restrict a traveling motion in a direction in which the risk of tipping-over increases as the prohibition of the traveling motion. Note that, in the traveling motion on the downward inclination, the direction in which the risk of tipping-over increases (second inclination direction D2) corresponds to an example of a "second predetermined direction" of the present disclosure.

Restriction of Swivel Motion

Next, a process of restricting a motion of the swivel body 4 performed by the controller 11 will be described with reference to FIGS. 5A to 8. FIG. 5A is a diagram illustrating the work machine 1 located on the inclined surface SL. As illustrated in FIG. 5A, the work unit 3 of the work machine 1 is located in the first inclination direction D1 and suspends an object W.

Swivel Motion in Upward State on Inclination

First, restriction control on a swivel motion of the work machine 1 in an upward state on the inclined surface SL will be described.

Figure 5B:
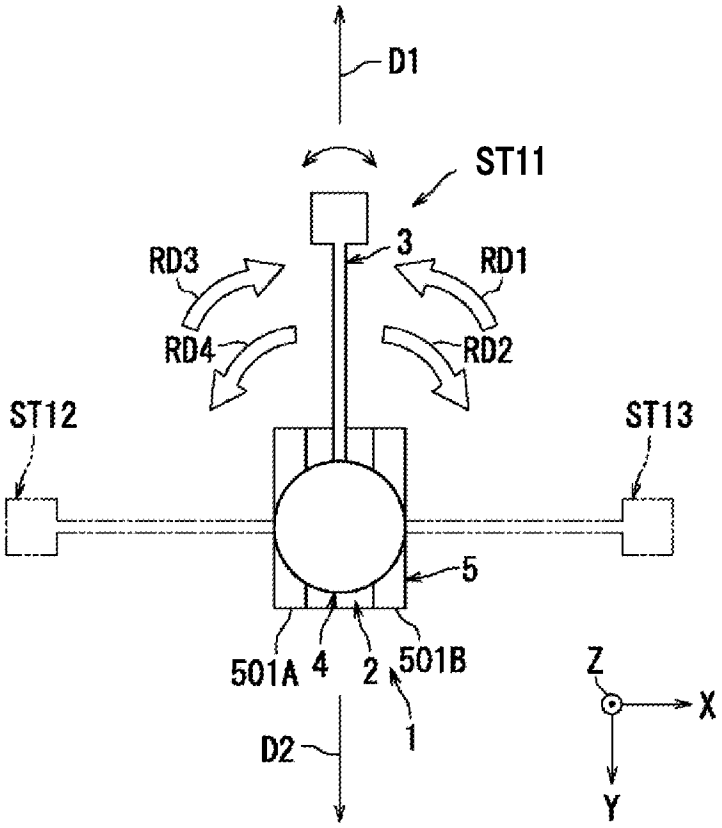
FIG. 5B is a plan view of the work machine of FIG. 5A.
Figure 5A:
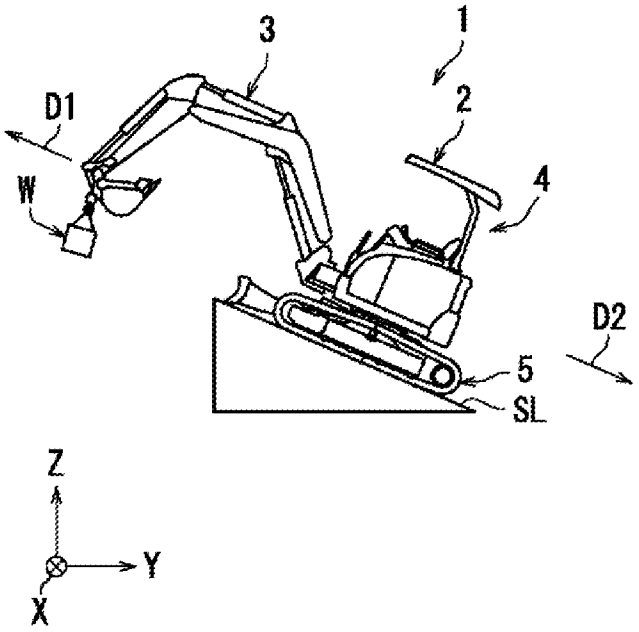
FIG. 5A is a diagram illustrating the work machine located in an inclined surface.

In FIG. 5B, an 11th posture ST11 indicates a posture of the work machine 1 obtained when an angle of the swivel body 4 relative to the traveling body 5 is a reference angle. The reference angle is, for example, an angle of "0°" of the swivel body 4 relative to the traveling body 5. In FIG. 5B, the work unit 3 of the work machine 1 in the 11th posture ST11 is positioned in the first inclination direction D1.

A 12th posture ST12 indicates a posture of the work machine 1 obtained when the swivel body 4 swivels leftward relative to the traveling body 5 at a predetermined angle from the reference angle. The predetermined angle is, for example, an angle of "90°" of the swivel body 4 relative to the traveling body 5. In FIG. 5B, the work unit 3 of the work machine 1 in the 12th posture ST12 is in a state in which the work unit 3 intersects with the first inclination direction D1 and is positioned on a side of the first crawler 501A.

A 13th posture ST13 indicates a posture of the work machine 1 obtained when the swivel body 4 swivels rightward relative to the traveling body 5 at a predetermined angle from the reference angle. The predetermined angle is, for example, an angle of "90°" of the swivel body 4 relative to the traveling body 5. In FIG. 5B, the work unit 3 of the work machine 1 in the 13th posture ST13 is in a state in which the work unit 3 intersects with the first inclination direction D1 and is positioned on a side of the second crawler 501B.

The swivel body 4 of the work machine 1 swivels in a first swivel direction RD1. The first swivel direction RD1 indicates a swivel direction from the 13th posture ST13 to the 11th posture ST11. In FIG. 5B, the first swivel direction RD1 indicates a direction in which the swivel body 4 swivels such that the work unit 3 faces up the inclined surface SL where the main body 2 is located.

The swivel body 4 of the work machine 1 swivels in a second swivel direction RD2. The second swivel direction RD2 indicates a swivel direction from the 11th posture ST11 to the 13th posture ST13. In FIG. 5B, the second swivel direction RD2 indicates a direction in which the swivel body 4 swivels such that the work unit 3 faces down the inclined surface SL where the main body 2 is located.

The swivel body 4 of the work machine 1 swivels in a third swivel direction RD3. The third swivel direction RD3 indicates a swivel direction from the 12th posture ST12 to the 11th posture ST11. In FIG. 5B, the third swivel direction RD3 indicates a direction in which the swivel body 4 swivels such that the work unit 3 faces up the inclined surface SL where the main body 2 is located.

The swivel body 4 of the work machine 1 swivels in a fourth swivel direction RD4. The fourth swivel direction RD4 indicates a swivel direction from the 11th posture ST11 to the 12th posture ST12. In FIG. 5B, the fourth swivel direction RD4 indicates a direction in which the swivel body 4 swivels such that the work unit 3 faces down the inclined surface SL where the main body 2 is located.

Restriction of Swivel Speed

As shown in FIGS. 5A and 5B, when a posture of the work machine 1 positioned on the inclined surface SL satisfies the first determination condition, the controller 11 restricts a swivel motion of the swivel body 4. Specifically, the controller 11 reduces the swivel speed to a speed limit irrespective of the swivel directions RD1 to RD4 by means of a method the same as the speed restriction process described above.

Prohibition of Swivel Motion

Furthermore, when the 11th posture ST11 of the work machine 1 satisfies the determination condition described above, the controller 11 may prohibit a swivel motion in a predetermined direction as a motion restriction of the swivel body 4. In the example shown in FIGS. 5A and 5B, a swivel motion from an upper direction of the inclined surface SL to a lower direction that increases the risk of tipping-over of the work machine 1 (the second swivel direction RD2 and the fourth swivel direction RD4) may be prohibited. In other words, the second swivel direction RD2 and the fourth swivel direction RD4 shown in FIG. 5B individually correspond to examples of a "first predetermined direction" of the present disclosure.

On the other hand, the controller 11 may also restrict a swivel range as another restriction process that prohibits a swivel motion. In a process of restricting a swivel range, the controller 11 may restrict a swivel range to a range TR in which the risk of tipping-over does not increase (a range in which a change in a position of a center of gravity does not increase), for example. In this way, a restriction process suitable for a work environment may be executed by enabling selection of prohibition of a motion in a predetermined direction or prohibition of a motion outside a predetermined range. For example, in the example shown in FIGS. 5A and 5B, the restriction process of prohibiting a motion in the predetermined direction prohibits a swivel motion, and therefore, risk avoidance is substantially difficult. However, when the restriction process of prohibiting a motion out of the predetermined range is executed, a swivel motion in the predetermined range is enabled, and therefore, the risk avoidance is enabled.

Figure 6B:
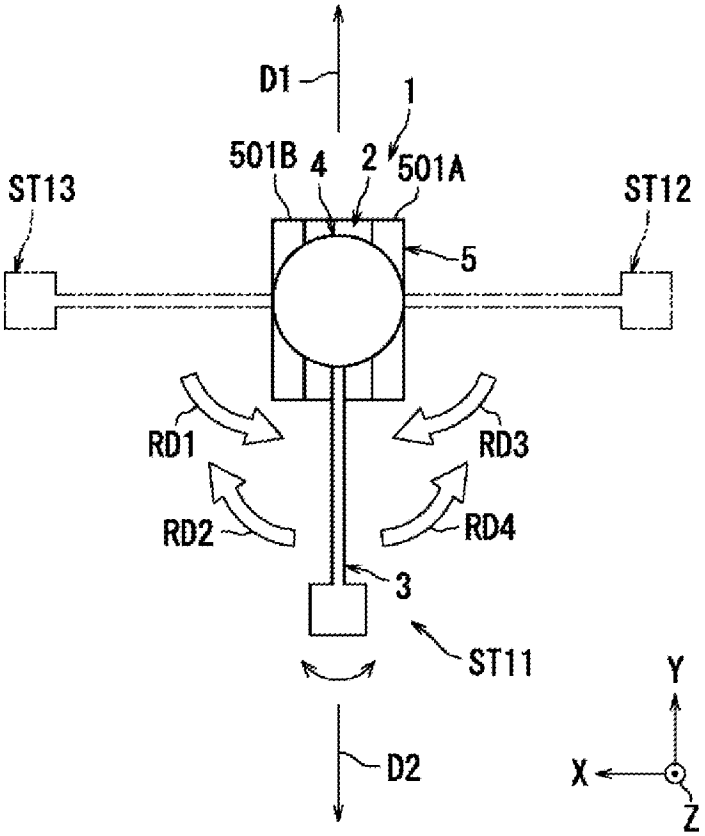
FIG. 6B is a plan view of the work machine of FIG. 6A.
Figure 6A:
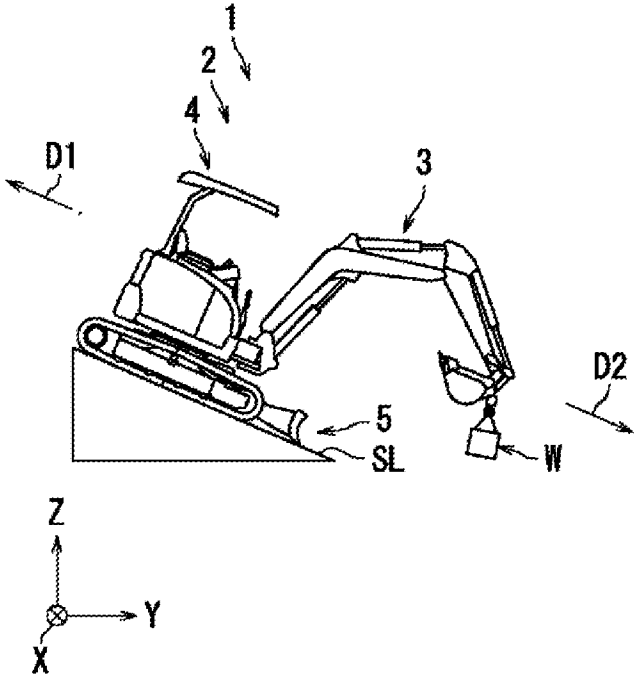
FIG. 6A is a diagram illustrating the work machine located in an inclined surface.

Note that, as shown in FIGS. 6A and 6B, when the work unit 3 of the work machine 1 is positioned in the second inclination direction D2 (a downward state on an inclination), only a swivel motion from a lower direction to an upper direction on the inclined surface SL in which the risk of tipping-over is low is permitted for the work unit 3, and therefore, the restriction process described above is not performed.

In this way, the controller 11 executes the restriction process, such as restriction of a swivel speed or prohibition of a swivel motion, based on a determination result indicating a posture of the work machine 1. In this case, as with the traveling motion described above, the controller 11 may execute the restriction process in stages, and for example, a swivel speed may be restricted as a first restriction process based on the first determination condition and a swivel direction may be restricted as a second restriction process based on the second determination condition.

Swivel Motion in Lateral State on Inclination

Next, restriction control on a swivel motion of the work machine 1 in a lateral state on the inclined surface SL will be described.

Figure 7B:
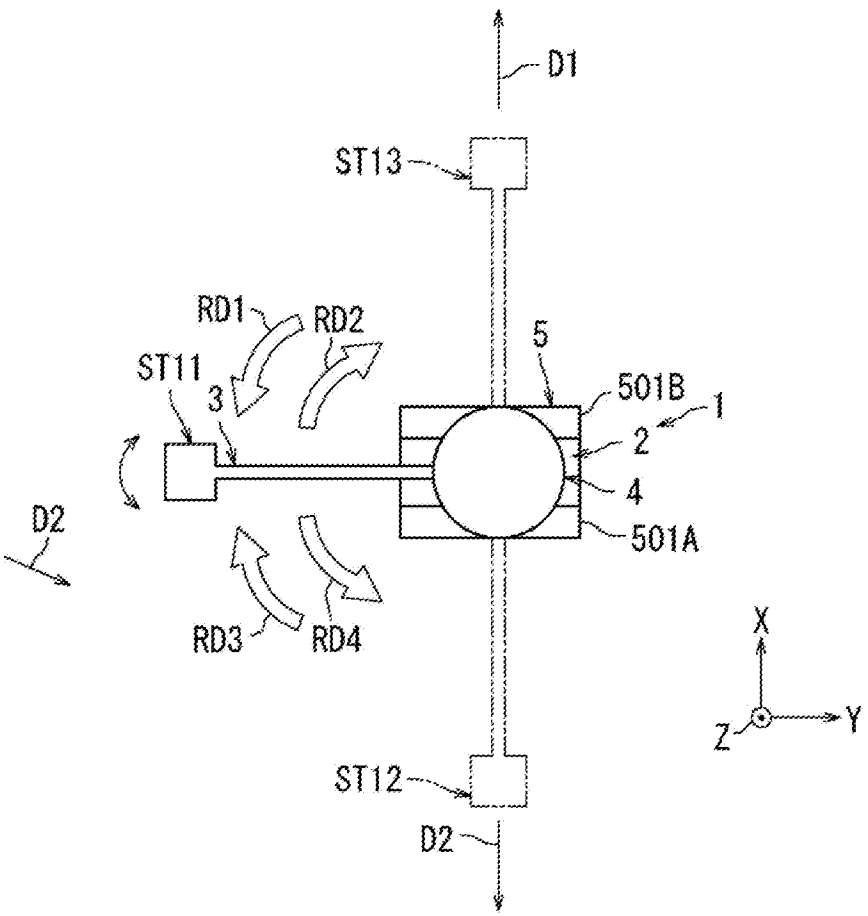
FIG. 7B is a plan view of the work machine of FIG. 7A.
Figure 7A:
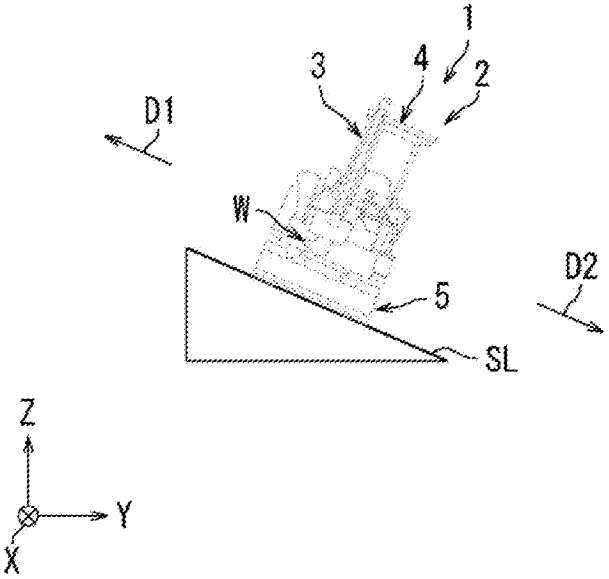
FIG. 7A is a diagram illustrating the work machine located in an inclined surface.

FIG. 7A is another diagram illustrating the work machine 1 located on the inclined surface SL. As illustrated in FIG. 7A, the work unit 3 of the work machine 1 is positioned in a direction intersecting with the first inclination direction D1 or the second inclination direction D2 and suspends the object W.

In FIG. 7B, the work unit 3 of the work machine 1 in the 11th posture ST11 intersects with the first inclination direction D1 or the second inclination direction D2. In FIG. 7B, the work unit 3 of the work machine 1 in the 12th posture ST12 is positioned in the second inclination direction D2. In FIG. 7B, the work unit 3 of the work machine 1 in the 13th posture ST13 is positioned in the first inclination direction D1.

The swivel body 4 of the work machine 1 swivels in the first swivel direction RD1, the second swivel direction RD2, the third swivel direction RD3, and the fourth swivel direction RD4. In FIG. 7B, the first swivel direction RD1 and the fourth swivel direction RD4 indicate a direction in which the swivel body 4 swivels such that the work unit 3 faces down the inclined surface SL where the main body 2 is located. In FIG. 7B, the second swivel direction RD2 and the third swivel direction RD3 indicate a direction in which the swivel body 4 swivels such that the work unit 3 faces up the inclined surface SL where the main body 2 is located.

For example, as shown in FIG. 7B, when the swivel body 4 of the work machine 1 in the 11th posture ST11 swivels in the first swivel direction RD1 or the fourth swivel direction RD4, the swivel body 4 swivels in the direction down the inclined surface SL where the main body 2 is located. In other words, the first swivel direction RD1 and the fourth swivel direction RD4 shown in FIG. 7B correspond to examples of the "first predetermined direction" of the present disclosure.

Restriction of Swivel Speed

When the 11th posture ST11 of the work machine 1 satisfies the determination condition described above, the controller 11 reduces a swivel speed to the speed limit as the motion restriction of the swivel body 4, for example, by means of a method the same as the speed restriction process described above.

Prohibition of Swivel Motion

Furthermore, when the 11th posture ST11 of the work machine 1 satisfies the determination condition described above, the controller 11 may restrict a swivel motion in a direction in which the risk of tipping-over increases as the prohibition of a swivel motion by means of a method the same as the prohibition restriction process described above. Note that, in the swivel motion in the lateral state on the inclination, the direction (fourth swivel direction RD4) in which the risk of tipping-over increases corresponds to an example of the "first predetermined direction" of the present disclosure.

On the other hand, the controller 11 may also restrict a swivel range as another restriction process that prohibits a swivel motion. In the process of restricting a swivel range, the controller 11 may restrict a swivel range to a range in which the risk of tipping-over does not increase (a range in which a change in a position of a center of gravity does not increase), for example.

In this way, the controller 11 executes the restriction process, such as restriction of a swivel speed or prohibition of a swivel motion, based on a determination result indicating a posture of the work machine 1. In this case, as with the traveling motion described above, the controller 11 may execute the restriction process in stages, and for example, a swivel speed may be restricted as a first restriction process based on the first determination condition and a swivel direction may be restricted as a second restriction process based on the second determination condition.

Pattern Table Showing Method for Restricting Swivel Motion

The above description shows the specific examples of the processes of restricting a swivel motion, but the restriction processes may also be performed based on a predetermined pattern table. Therefore, the pattern table of the swivel body 4 of the work machine 1 will now be described with reference to FIG. 8. FIG. 8 is a diagram illustrating a pattern table of the swivel body 4 of the work machine 1 according to this embodiment. A pattern table TB for the swivel body 4 shown in FIG. 8 is stored in the storage unit 21. The pattern table TB shows a state of the work machine 1 and a possible motion of the swivel body 4 corresponding to the state of the work machine 1. Specifically, the pattern table TB includes state information T11, state information T12, state information T13, state information T14, first swivel information T15 and second swivel information T16.

The state information T11 indicates a state of the traveling body 5. The state information T12 indicates a state of the blade 511. The state information T13 indicates a state of the swivel body 4. The state information T14 indicates a state of the work unit 3.

The first swivel information T15 indicates whether the swivel body 4 may swivel to the right. The possibility of swiveling of the swivel body 4 to the right is indicated by a symbol. When the swiveling to the right of the swivel body 4 is permitted, "O" is shown. When swiveling to the right of the swivel body 4 is not permitted, "x" is shown.

The second swivel information T16 indicates whether the swivel body 4 may swivel to the left. The possibility of swiveling of the swivel body 4 to the left is indicated by a symbol. When the swiveling to the left of the swivel body 4 is permitted, "O" is shown. When swiveling to the left of the swivel body 4 is not permitted, "x" is shown.

For example, the state information T11 in the pattern table TB indicates that a front-rear direction of the inclined surface SL and the traveling body 5 are parallel to each other. The state information T12 in the pattern table TB indicates that the blade 511 is located in the first inclination direction D1. The state information T13 in the pattern table TB indicates that an angle of the swivel body 4 relative to the traveling body 5 is "0°". The state information T14 in the pattern table TB indicates that the work unit 3 is located in the first inclination direction D1. In this case, the first swivel information T15 indicates that the swiveling to the right of the swivel body 4 is not permitted. In other words, the first swivel information T15 indicates that a motion of the work unit 3 in a retracting direction DB is restricted. Furthermore, the second swivel information T16 indicates that the swiveling to the left of the swivel body 4 is permitted.

In this way, since content of the restriction process is predetermined using the pattern table, system development for executing the restriction process is facilitated.

Restriction of Motion of Work Unit 3: Motion of Work Unit 3 in Upward State on Inclination First, restriction control of restricting a motion of the work unit 3 in a state in which the work machine is located on the upward inclined surface SL will be described.

Figure 9A:
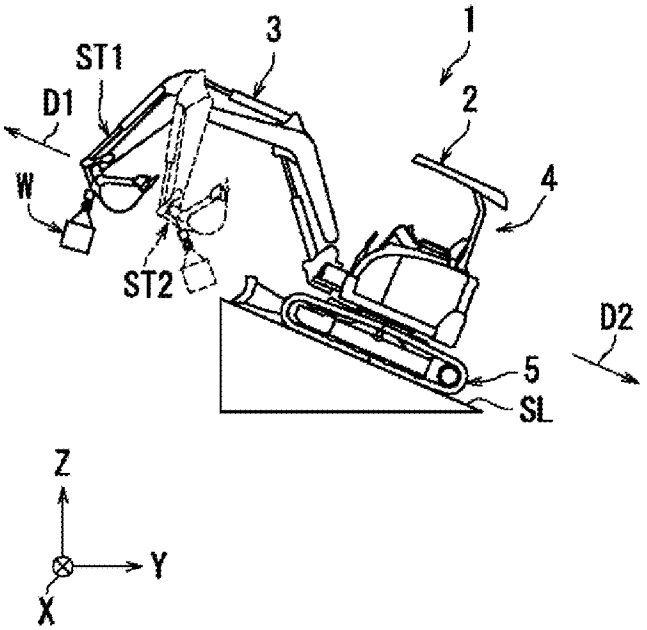
FIG. 9A is a diagram illustrating the work machine located in an inclined surface.

A process of restricting a motion of the work unit 3 performed by the controller 11 will be described with reference to FIGS. 9 to 11. As illustrated in FIG. 9A, the work unit 3 of the work machine 1 is located in an upward direction on the inclination (first inclination direction D1) and suspends an object W.

FIG. 9A also shows the work machine 1 in the first posture ST1 and the work machine 1 in the second posture ST2. The first posture ST1 is in a state in which a position of the work unit 3 is in the first inclination direction D1 relative to a position of the work unit 3 in the second posture ST2. The second posture ST2 is in a state in which a position of the work unit 3 is in the second inclination direction D2 relative to a position of the work unit 3 in the first posture ST1. The second inclination direction D2 indicates a direction opposite to the first inclination direction D1. Specifically, the second inclination direction D2 indicates a direction from the top of the inclined surface SL to the base end of the inclined surface SL. Specifically, the second inclination direction D2 indicates a direction downward the inclined surface SL where the main body 2 is located. The second inclination direction D2 indicates a so-called direction toward a valley side. The second inclination direction D2 corresponds to an example of the "first predetermined direction".

Figure 9B:
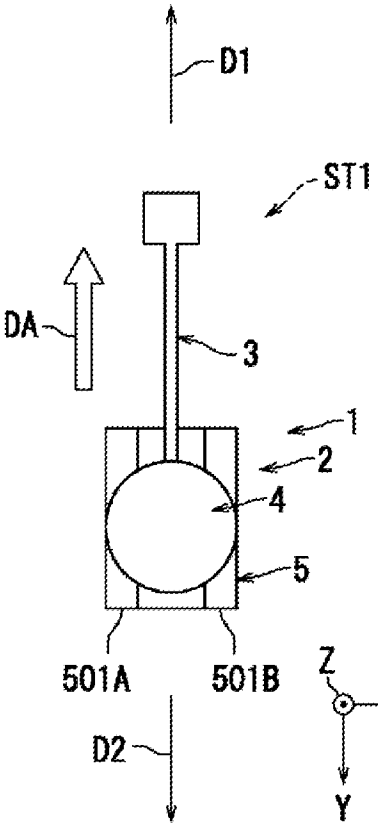
FIG. 9B is a plan view of the work machine of FIG. 9A in a first posture.
Figure 9C:
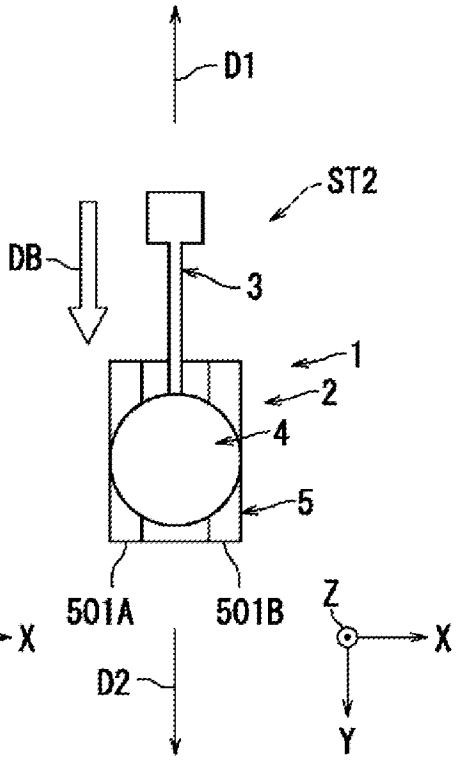
FIG. 9C is a plan view of the work machine of FIG. 9A in a second posture.

FIG. 9B is a plan view of the work machine 1 of FIG. 9A in the first posture ST1. FIG. 9C is a plan view of the work machine 1 of FIG. 9A in the second posture ST2.

Restriction of Motion Speed of Work Unit 3

As illustrated in FIGS. 9A to 9C, when the first posture ST1 of the work machine 1 satisfies the determination condition described above, the controller 11 restricts a motion speed of the work unit 3. Specifically, the controller 11 reduces the motion speed of the work unit 3 by the restriction process.

Prohibition of Motion of Work Unit 3

Furthermore, when the first posture ST1 of the work machine 1 satisfies the determination condition described above, the controller 11 may prohibit a motion of the work unit 3 as the motion restriction of the work unit 3. For example, a motion of the work unit 3 in a predetermined direction may be restricted. In the example in FIGS. 9A to 9C, a motion from an upper side to a lower side of the inclined surface SL may be prohibited. In other words, the work unit 3 is prevented from moving in the second inclination direction D2 (retracting direction DB) and entering the second posture ST2 from the first posture ST1. Therefore, a work motion of the work unit 3 in the direction in which the risk of tipping-over of the work machine 1 increases (a change in a position of the center of gravity increases) is restricted. As a result, the work machine 1 located on the inclined surface SL may be prevented from tipping over due to a work motion of the work unit 3.

On the other hand, the controller 11 may also restrict a motion range of the work unit 3 as another restriction process that prohibits a motion of the work unit 3. The controller 11 may restrict a motion range of the work unit 3 to a range in which the risk of tipping-over does not increase (a range in which a change in a position of the center of gravity does not increase), for example.

Motion of Work Unit 3 in Downward State on Inclination

Next, restriction control of restricting a motion of the work unit 3 in a state in which the work machine 1 is located on the downward inclined surface SL will be described.

Figure 10A:
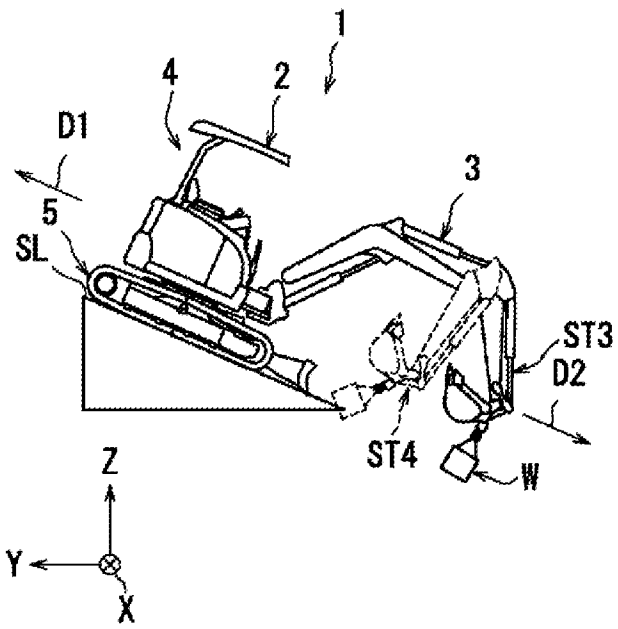
FIG. 10A is a diagram illustrating the work machine located in an inclined surface.

FIG. 10A is a diagram illustrating the work machine 1 located on the inclined surface SL. As illustrated in FIG. 10A, the work unit 3 of the work machine 1 is located in a downward direction of the inclination (second inclination direction D2) and suspends an object W.

FIG. 10A also shows the work machine 1 in the third posture ST3 and the work machine 1 in the fourth posture ST4. The third posture ST3 indicates a state in which a position of the work unit 3 is in the second inclination direction D2 relative to a position of the work unit 3 in the fourth posture ST4. The fourth posture ST4 indicates in a state in which a position of the work unit 3 is in the first inclination direction D1 relative to a position of the work unit 3 in the third posture ST3.

Restriction of Motion Speed of Work Unit 3

Figure 10B:
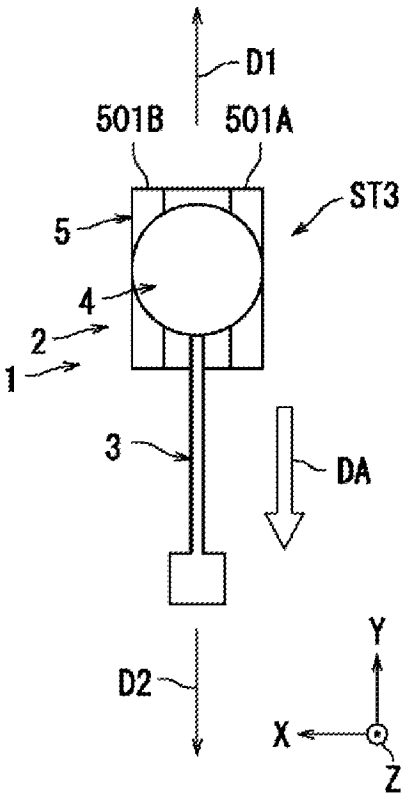
FIG. 10B is a plan view of the work machine of FIG. 10A in a third posture.
Figure 10C:
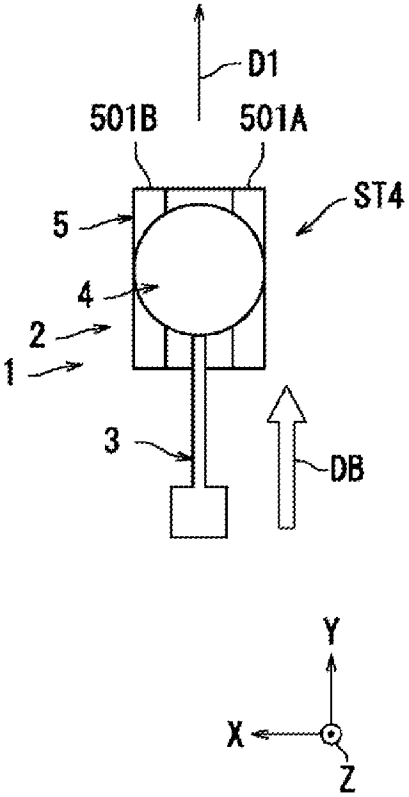
FIG. 10C is a plan view of the work machine of FIG. 10A in a fourth posture.

As illustrated in FIG. 10B, when the third posture ST3 of the work machine 1 satisfies the determination condition described above, the controller 11 restricts a motion of the work unit 3. Specifically, the controller 11 reduces the motion speed of the work unit 3 by the restriction process. An extending direction DA in FIG. 10B is the same direction as the second inclination direction D2. The second inclination direction D2 in FIG. 10B corresponds to an example of the "first predetermined direction".

Prohibition of Motion of Work Unit 3

Furthermore, when the third posture ST3 of the work machine 1 satisfies the determination condition described above, the controller 11 may prohibit a motion of the work unit 3 as the motion restriction of the work unit 3. For example, a motion of the work unit 3 in a predetermined direction may be restricted. In the example in FIGS. 10A to 10C, a motion from an upper side to a lower side of the inclined surface SL may be prohibited. In other words, the work unit 3 is prevented from moving in the second inclination direction D2 (extending direction DA) and entering the third posture ST3 from the fourth posture ST4.

On the other hand, the controller 11 may also restrict a motion range of the work unit 3 as another restriction process that prohibits a motion of the work unit 3. The controller 11 may restrict a motion range of the work unit 3 to a range in which the risk of tipping-over does not increase (a range in which a change in a position of the center of gravity does not increase), for example.

Pattern Table Showing Method for Restricting Motion of Work Unit 3

The above description shows the specific examples of the processes of restricting a motion of the work unit 3, but the restriction processes may also be performed based on a predetermined pattern table. Therefore, the process of the controller 11 in restriction of a motion of the work unit 3 will now be described in more detail with reference to FIGS. 2 to 11. FIG. 11 shows a pattern table TA for the work unit 3.

The pattern table TA for the work unit 3 shown in FIG. 11 is stored in the storage unit 21. The pattern table TA shows a state of the work machine 1 and a possible work of the work unit 3 corresponding to the state of the work machine 1. Specifically, the pattern table TA includes state information T1, state information T2, state information T3, state information T4, first work information T5, and second work information T6.

The state information T1 indicates a state of the traveling body 5. Specifically, a position of the traveling body 5 relative to the inclined surface SL is indicated. Examples of the state of the traveling body 5 include a state in which the inclined surface SL and the front-rear direction of the traveling body 5 are parallel to each other and a state in which the inclined surface SL and the front-rear direction of the traveling body 5 intersect with each other.

The state information T2 indicates a state of the blade 511.

Specifically, a position of the blade 511 relative to the inclined surface SL is indicated. Examples of the state of the blade 511 include a state in which the blade 511 is positioned in the first inclination direction D1 and a state in which the blade 511 is positioned in the second inclination direction D2.

The state information T3 indicates a state of the swivel body 4. Specifically, the state information T3 indicates an angle of the swivel body 4 relative to the traveling body 5. Examples of the state of the swivel body 4 include a state in which the angle of the swivel body 4 relative to the traveling body 5 is in a range from "0°" to "90°".

The state information T4 indicates a state of the work unit 3. Specifically, the state information T4 indicates a position of the work unit 3 relative to the inclined surface SL. Examples of the state of the work unit 3 include a state in which the work unit 3 is positioned in the first inclination direction D1 and a state in which the work unit 3 is positioned in the second inclination direction D2.

The first work information T5 indicates whether the work unit 3 may move in the extending direction DA. The possibility of a motion of the work unit 3 in the extending direction DA is indicated by a symbol. When a motion in the extending direction DA of the work unit 3 is permitted, "O" is shown. When a motion in the extending direction DA of the work unit 3 is not permitted, "x" is shown.

The second work information T6 indicates whether the work unit 3 can move in the retracting direction DB. The possibility of a motion of the work unit 3 in the retracting direction DB is indicated by a symbol. When a motion in the retracting direction DB of the work unit 3 is permitted, "O" is shown. When a motion in the retracting direction DB of the work unit 3 is not permitted, "x" is shown.

For example, the state information T1 in the pattern table TA indicates that front-rear directions of the inclined surface SL and the traveling body 5 are parallel to each other. The state information T2 in the pattern table TA indicates that the blade 511 is located in the first inclination direction D1. The state information T3 in the pattern table TA indicates that an angle of the swivel body 4 relative to the traveling body 5 is "0°". The state information T4 in the pattern table TA indicates that the work unit 3 is located in the first inclination direction D1. In this case, the first work information T5 permits a motion of the work unit 3 in the extending direction DA. Furthermore, the second work information T6 does not permit a motion of the work unit 3 in the retracting direction DB. In other words, the second work information T6 restricts a motion of the work unit 3 in the retracting direction DB.

In this way, since content of the restriction process is predetermined using the pattern table, system development for executing the restriction process is facilitated.

Switching of Work Mode

In the work machine 1 of this embodiment, a plurality of work modes may be provided, and the controller 11 may execute the restriction process in a predetermined work mode selected from among the work modes. Examples of the work mode include an excavation mode in which the bucket 303 is used for excavation and a crane mode in which operation is performed while a load is suspended on the crane hook of the bucket 303. The controller 11 may then execute the restriction process based on the determination condition described above when the crane mode is selected, for example. In the crane mode, the risk of tipping-over of the work machine 1 is higher than in the other work modes because a considerable load is suspended by ropes or the like, and in addition, load swing may occur during the operation. On the other hand, in the excavation mode, the bucket 303 may temporarily accommodate an excavated object, but the risk of tipping over is lower than in the crane mode. Therefore, the controller 11 executes the restriction process during the work mode with a higher risk of tipping-over, thereby preventing a reduction in workability during the work mode with a lower risk of tipping-over. The crane mode corresponds to an example of the "predetermined work mode".

Furthermore, in the above example, the controller 11 executes the restriction process when the determination condition is satisfied during the predetermined work mode, but the operation is not limited to this. For example, the controller 11 may allow switching of the work mode when the determination condition is satisfied. In this case, switching to the crane mode is permitted in accordance with a posture of the main body 2. As a result, a crane operation in a posture with a high risk of tipping-over can be prevented, and occurrence of tipping-over of the work machine 1 can be avoided.

Reporting Process of Reporting Unit 19

Figure 12:
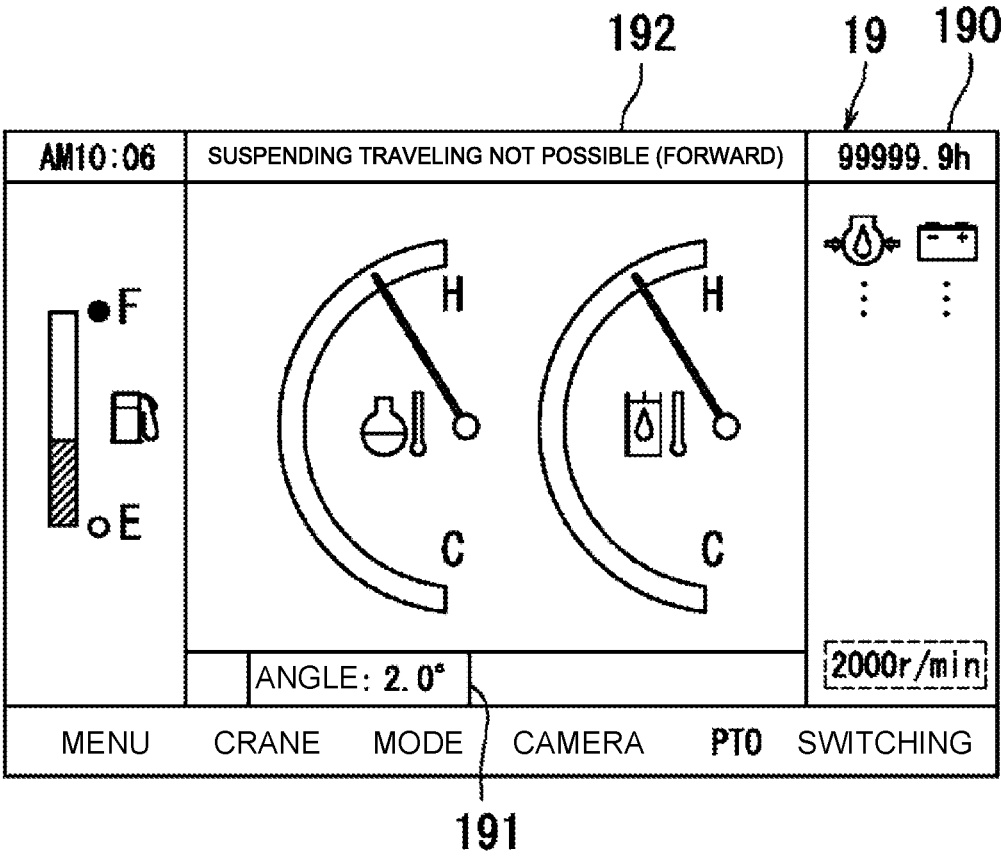
FIG. 12 is a diagram illustrating an image displayed on a display unit of a reporting unit of the work machine according to the embodiment.

Next, referring to FIG. 12, the reporting unit 19 will be described in detail. FIG. 12 is a diagram illustrating an image displayed on a display unit 190 of the reporting unit 19. The image displayed on the display unit 190 of the reporting unit 19 includes a first image 191 and a second image 192. The first image 191 indicates an angle corresponding to a posture of the main body 2 of the work machine 1. The second image 192 indicates the restriction process being performed by the controller 11.

As shown in FIG. 12, the reporting unit 19 reports a detection result of the first detection unit 12. Accordingly, the operator can be informed that the work machine 1 is located on an inclined surface. As a result, the operator can be encouraged to move the work machine 1 to a different position from the inclined surface.

Furthermore, as shown in FIG. 12, the reporting unit 19 reports content of the restriction process. Accordingly, the operator can be informed of content of the restriction process being performed by the controller 11. As a result, the operator can recognize the content of the restriction process.

When a change in a posture of the main body 2 satisfies the first determination condition, the reporting unit 19 can report content of the first restriction process. Furthermore, when a change in a posture of the main body 2 satisfies the second determination condition, the reporting unit 19 can report content of the second restriction process.

Furthermore, when a change in a posture of the main body 2 satisfies the determination condition in the second determiner, the reporting unit 19 provides a warning. Accordingly, it is possible to recognize that the work machine 1 may tip over. As a result, the operator can be encouraged to move the work machine 1 to a position where operation is available.

Flow of Restriction Process of Controller 11

Figure 13:
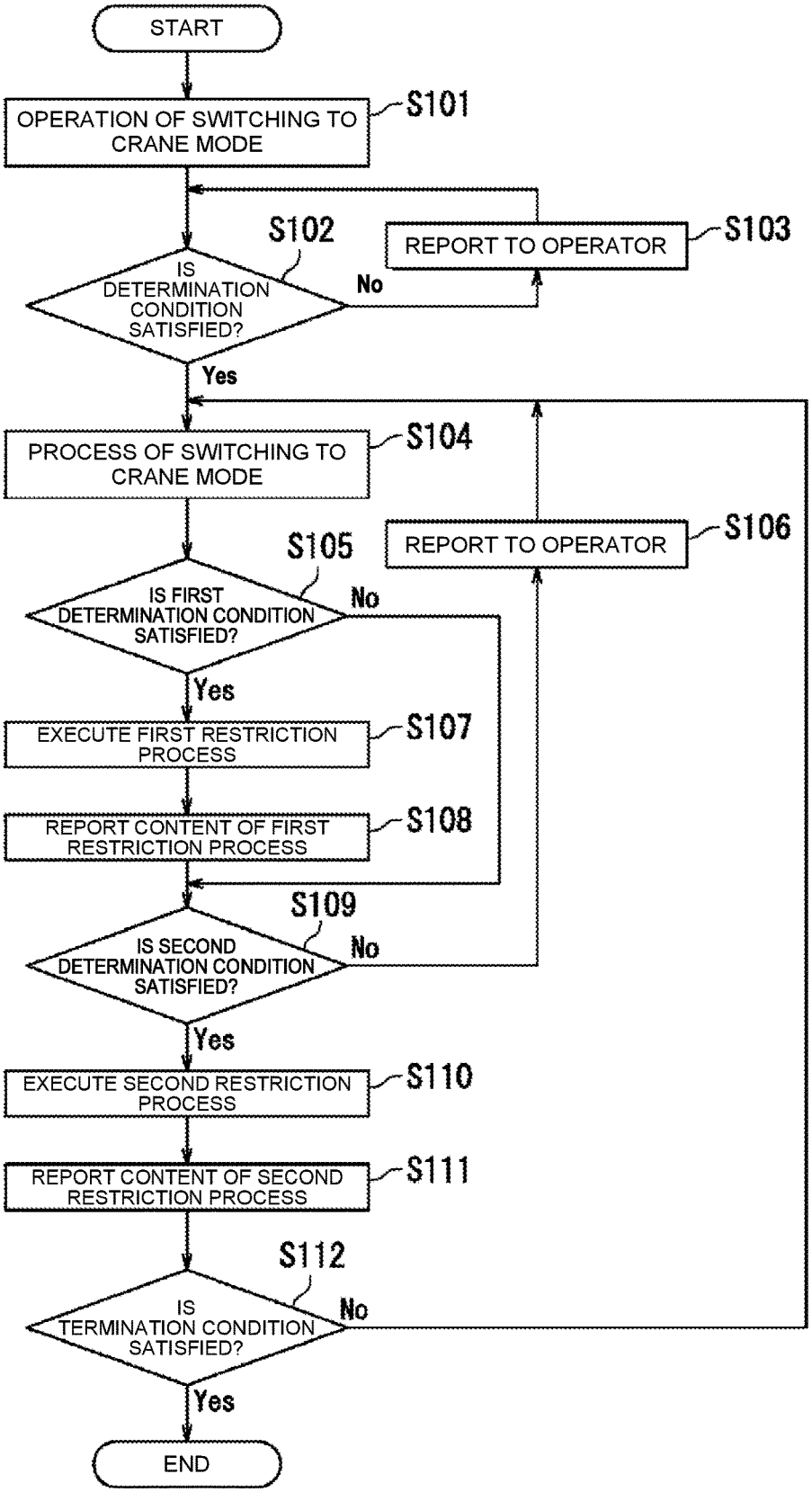
FIG. 13 is a flowchart of a process executed by a controller of the work machine according to the embodiment.

Referring now to FIG. 13, a process executed by the controller 11 of the work machine 1 will be described. FIG. 13 is a flowchart of a process executed by the controller 11 of the work machine 1. The process performed by the controller 11 of the work machine 1 includes step S101 to step S112.

In step S101, the operating unit 20 accepts an operation of switching to the crane mode of the work machine 1 performed by the operator. The process then proceeds to step S102.

In step S102, the controller 11 determines whether a posture of the main body 2 satisfies the first determination condition. When a posture of the main body 2 does not satisfy the first determination condition (No in step S102), the process proceeds to step S103. When a posture of the main body 2 satisfies the first determination condition (Yes in step S102), the process proceeds to step S104.

When the determination is negative in step S102, the controller 11 causes the reporting unit 19 to report information on the posture of the main body 2 and other information in step S103. The process then returns to step S102.

When the determination is affirmative in step S102, the controller 11 permits mode switching to the crane mode and executes a mode switching process in step S104. In subsequent processes, the work machine 1 operates in the crane mode. The process then proceeds to step S105.

In step S105, the controller 11 determines whether a posture of the main body 2 satisfies the first determination condition. When the posture of the main body 2 does not satisfy the first determination condition (No in step S105), the process proceeds to step S109. When the posture of the main body 2 satisfies the first determination condition (Yes in step S105), the process proceeds to step S107.

When the determination is affirmative in step S105, the controller 11 executes the first restriction process in step S107. Specifically, the controller 11 reduces a motion speed of the main body 2 and/or the work unit 3. The process then proceeds to step S108.

In step S108, the controller 11 causes the reporting unit 19 to report content of the first restriction process. The process then proceeds to step S109.

When the determination is negative in step S105 or after step S108, the controller 11 determines whether a posture of the main body 2 satisfies the second determination condition in step S109. When a posture of the main body 2 does not satisfy the second determination condition (No in step S109), the process proceeds to step S106. When a posture of the main body 2 satisfies the second determination condition (Yes in step S109), the process proceeds to step S110.

When the determination is affirmative in step S109, the controller 11 executes the second restriction process in step S110. Specifically, the controller 11 prohibits a motion of the main body 2 and/or the work unit 3. The process then proceeds to step S111.

In step S111, the controller 11 causes the reporting unit 19 to report content of the second restriction process. The process then proceeds to step S112.

In step S112, the controller 11 determines whether a condition for terminating the crane mode is satisfied. When the determination is negative (No in step S112), the process returns to step S104. When the determination is affirmative (Yes in step S112), the process is terminated.

When the determination is negative in step S109, the controller 11 cancels the restriction state in step S106. The process then returns to step S104.

The embodiment of the present disclosure has been described hereinabove with reference to the drawings. However, the present disclosure is not limited to the embodiment described above, and can be embodied in various modes in a range without departing from its spirit. Various inventions can be formed by combining the plurality of components disclosed in the above embodiment as appropriate. For example, some of the components may be removed from all the components shown in the embodiment. In addition, the components in the different examples may be combined as appropriate. The drawings are schematically illustrated with each component as a main subject in order to facilitate understanding, and the thicknesses, the lengths, the numbers, the spacings, and so on of the illustrated components may be different from actual ones due to convenience of the drawings. Furthermore, the speeds, the materials, the shapes, the sizes, and so on of the individual components illustrated in the above embodiment are merely examples and are not particularly limited, and various modifications may be made without substantially departing from the configurations of the present disclosure.

(1) Although the controller 11 of the work machine 1 of the first embodiment restricts at least one of a motion of the work unit 3 and a motion of the main body 2 in the crane mode, the restriction is not limited to this. For example, when the work unit 3 is in the mode of executing earth excavation work, the controller 11 may restrict at least one of a motion of the work unit 3 and a motion of the main body 2. Specifically, the controller 11 restricts at least one of a motion of the work unit 3 and a motion of the main body 2 based on a detection result of the first detection unit 12 and a detection result of the sixth detection unit 17. The controller 11 can calculate a weight of soil accommodated in the bucket 303 based on a pressure of working oil supplied to the boom cylinder 51*a* indicated by a detection result of the sixth detection unit 17. Therefore, the controller 11 may restrict at least one of a motion of the work unit 3 and a motion of the main body 2 based on an inclination of the main body 2 and a weight of soil.

(2) Although the controller 11 of this embodiment restricts a motion of the work unit 3 based on the pattern table TA, the reference of the restriction is not limited to this. For example, the controller 11 may restrict a motion of the work unit 3 based on a position of the center of gravity of the work machine 1.

For example, the controller 11 calculates a position of the center of gravity of the work machine 1 based on size information of the work machine 1, weight information of the work machine 1, a posture of the main body 2, a posture of the work unit 3, angle information of the swivel body 4, and load information. Specifically, the controller 11 calculates a position of the center of gravity of the work machine 1 based on the size information of the work machine 1, the weight information of the work machine 1, and detection results of the first to sixth detection units 12 to 17. The controller 11 then calculates the possibility of tipping-over of the work machine 1 based on the position of the center of gravity of the work machine 1. The controller 11 then restricts a motion of the work unit 3 based on a calculation result of the controller 11. As a result, the controller 11 can precisely restrict a motion of the work unit 3.

(3) Although the controller 11 of this embodiment restricts a motion of the swivel body 4 based on the pattern table TB, the reference of the restriction is not limited to this. For example, the controller 11 may restrict a motion of the swivel body 4 based on a position of the center of gravity of the work machine 1.

For example, the controller 11 calculates a position of the center of gravity of the work machine 1 based on the size information of the work machine 1, the weight information of the work machine 1, and detection results of the first to sixth detection units 12 to 17. The controller 11 then calculates the possibility of tipping-over of the work machine 1 based on the position of the center of gravity of the work machine 1. The controller 11 then restricts a motion of the swivel body 4 based on a calculation result of the controller 11. Consequently, the controller 11 can precisely restrict a motion of the swivel body 4.

(4) The storage unit 21 of the work machine 1 of this embodiment stores a detection result of the first detection unit 12. The controller 11 can perform a control process based on the detection result stored in the storage unit 21. For example, when an inclination of the inclined surface SL progressively increases, a direction in which the inclination of the inclined surface SL increases (i.e., a direction in which a change in posture of the main body 2 increases) and a magnitude of the inclination change can be identified by accumulating detection results of the first detection unit 12 in the storage unit 21. Accordingly, the controller 11 can estimate a change in a posture of the main body 2 based on the detection result of the first detection unit 12 stored in the storage unit 21. Therefore, the controller 11 can perform the restriction process in advance before the main body 2 reaches an estimated inclination angle. As a result, the restriction process can be performed before the work machine 1 is positioned on the inclined surface SL. Note that the direction in which the inclination of the inclined surface SL increases corresponds to the "second predetermined direction" in the present disclosure.

The controller 11 can estimate a change in a posture of the main body 2 caused by a traveling motion of the traveling body 5 based on the detection result of the first detection unit 12 stored in the storage unit 21. The controller 11 then executes the restriction process based on an estimated result. Therefore, the controller 11 can perform the restriction process of restricting a motion of the work machine 1 based on the change in a posture of the main body 2 estimated by the controller 11. As a result, the restriction process may be executed before the work machine 1 is positioned on the inclined surface SL and tipping-over of the work machine 1 may be avoided.

(5) The controller 11 of the work machine 1 of this embodiment may use a detection result of the seventh detection unit 18 to restrict a motion of the work machine 1. The detection result of the seventh detection unit 18 is stored in the storage unit 21. The seventh detection unit 18 can detect road surface conditions. Examples of the road surface conditions include an inclination angle of a road surface. The controller 11 specifies a road surface condition based on a detection result of the seventh detection unit 18 stored in the storage unit 21. Accordingly, based on the road surface condition specified by the controller 11, the controller 11 can restrict a motion of the work machine 1. As a result, tipping-over of the work machine 1 located on the inclined surface SL may be avoided.

In addition, since the detection result of the seventh detection unit 18 stored in the storage unit 21 is used, the controller 11 can specify an angle of the inclined surface SL in a traveling direction of the work machine 1. Accordingly, the work machine 1 may be prevented from moving close to the inclined surface SL in the traveling direction of the work machine 1. As a result, the work machine 1 is prevented from entering the inclined surface SL in which the work machine 1 is likely to tip over.

INDUSTRIAL APPLICABILITY

The present disclosure provides a work machine and has industrial applicability.

REFERENCE SIGNS LIST

1: Work machine
2: Main body
3: Work unit
4: Swivel body
5: Traveling body
12: First detection unit
111: Restrictor
112: Specifier
113: First determiner
114: Second determiner

The invention claimed is:

1. A work machine comprising:
a work unit that executes work;
a main body that supports the work unit;

a detection unit that detects a posture of the main body; and a controller that prevents the work machine from tipping over by executing a restriction process of restricting at least one of a motion of the work unit and a motion of the main body, based on a result of detection of the detection unit, wherein the controller restricts a motion of the work unit in a first predetermined direction in the restriction process, and the first predetermined direction indicates a downward direction of an inclined surface where the main body is positioned, and the main body supports the work unit and includes a swivel body supported by a traveling body in a swivelable manner, and the controller restricts a swivel motion of the swivel body in the first predetermined direction in the restriction process.

2. The work machine according to claim 1, wherein the controller executes the restriction process based on a change in the posture of the main body from a reference posture.

3. The work machine according to claim 2, wherein the reference posture includes the posture of the main body obtained when the main body is disposed on a level surface.

4. The work machine according to claim 1, wherein the main body includes the traveling body that travels, and the controller executes the restriction process based on a change in the posture of the main body caused by traveling of the traveling body.

5. The work machine according to claim 1, wherein the controller specifies a posture of the work unit, and executes the restriction process based on a posture of the work unit and the posture of the main body.

6. The work machine according to claim 1, wherein the restriction process includes a first restriction process of restricting a motion speed and a second restriction process of prohibiting a motion.

7. The work machine according to claim 1, wherein the controller executes the restriction process based on a determination condition indicating an inclination angle of the main body.

8. The work machine according to claim 7, wherein the determination condition includes a first determination condition and a second determination condition different from the first determination condition, and the controller executes a first restriction process based on the first determination condition and executes a second restriction process based on the second determination condition.

9. The work machine according to claim 1, wherein the controller restricts a traveling motion of the traveling body in a second predetermined direction in the restriction process, and the second predetermined direction indicates a direction in which a change in the posture of the main body increases.

10. The work machine according to claim 1, further comprising a reporting unit that reports the detection result of the detection unit.

11. The work machine according to claim 10, wherein the reporting unit reports content of the restriction process.

12. The work machine according to claim 1, further comprising:

a storage unit that stores the detection result of the detection unit, wherein the controller executes the restriction process based on the detection result stored in the storage unit.

13. The work machine according to claim 12, wherein the controller estimates a change in the posture of the main body caused by a traveling motion based on the detection result stored in the storage unit and executes the restriction process based on the estimation.

14. The work machine according to claim 1, wherein the work machine has a plurality of work modes that are switchable from one to another, and the controller executes the restriction process based on the detection result of the detection unit in a predetermined one of the work modes.

15. The work machine according to claim 14, wherein the controller permits switching to a predetermined one of the work modes based on the detection result of the detection unit.

* * * * *